US010699688B2

(12) United States Patent
Elford et al.

(10) Patent No.: US 10,699,688 B2
(45) Date of Patent: Jun. 30, 2020

(54) ACOUSTIC ATTENUATOR

(71) Applicant: SONOBEX LIMITED, Watford, Hertfordshire (GB)

(72) Inventors: Daniel Elford, Leamington Spa (GB); Luke Chalmers, Leamington Spa (GB); Richard Wilson, Cubbington (GB)

(73) Assignee: SONOBEX LIMITED, Watford (GB)

( * ) Notice: Subject to any disclaimer, the term of this patent is extended or adjusted under 35 U.S.C. 154(b) by 258 days.

(21) Appl. No.: 15/509,360

(22) PCT Filed: Mar. 23, 2015

(86) PCT No.: PCT/GB2015/050852

§ 371 (c)(1),
(2) Date: Mar. 7, 2017

(87) PCT Pub. No.: WO2016/038326

PCT Pub. Date: Mar. 17, 2016

(65) Prior Publication Data

US 2017/0263235 A1 Sep. 14, 2017

(30) Foreign Application Priority Data

Sep. 8, 2014 (GB) ..... 1415874.5

(51) Int. Cl.
*G10K 11/172* (2006.01)

(52) U.S. Cl.
CPC ..... *G10K 11/172* (2013.01)

(58) Field of Classification Search
CPC ..... G10K 11/172; G10K 11/175; E04B 2001/8428; E04B 2001/8433; E04B 2001/8438
USPC ..... 181/210, 286, 293
See application file for complete search history.

(56) References Cited

U.S. PATENT DOCUMENTS 3,269,484 A * 8/1966 Lighter ..... E01F 8/0076 181/290
4,095,669 A * 6/1978 Bond, Sr. ..... E01F 8/0052 181/210
4,100,993 A * 7/1978 Feder ..... G10K 11/172 181/213

(Continued)

FOREIGN PATENT DOCUMENTS

AU 5414286 9/1986
CN 101329864 12/2008

(Continued)

OTHER PUBLICATIONS

International Search Report for PCT/GB2015/050852, dated Oct. 27, 2015, 6 pages.

*Primary Examiner* — Jeremy A Luks
(74) *Attorney, Agent, or Firm* — Nixon & Vanderhye P.C.

(57) ABSTRACT

The invention provides an acoustic attenuator comprising: a body defining a cavity therein and having at least one open aperture in fluid communication with the cavity; and opposing first and second walls, the second wall being substantially parallel to the first wall, the body comprising at least one of the first and second walls, wherein the aperture and the cavity at least partly define a resonant frequency band across which the body attenuates incident acoustic waves, and wherein the first and second walls are separated by a gap.

29 Claims, 13 Drawing Sheets

(56) References Cited

U.S. PATENT DOCUMENTS 4,150,732 A * 4/1979 Hoch ..... F02C 7/24 181/213
4,189,027 A * 2/1980 Dean, III ..... G10K 11/172 181/286
4,231,447 A 11/1980 Chapman
5,587,564 A * 12/1996 Stief ..... G10K 11/172 181/286
5,869,792 A * 2/1999 Allen ..... F01D 25/30 181/224
5,959,265 A * 9/1999 Van Ligten ..... G10K 11/172 181/286
8,006,802 B2 * 8/2011 Honji ..... G10K 11/172 181/293
2005/0098379 A1 * 5/2005 Sato ..... B60R 13/0815 181/293
2005/0258000 A1 * 11/2005 Yano ..... B64F 1/26 181/210
2010/0171022 A1 * 7/2010 Fujimaki ..... G03F 7/70833 248/559
2012/0152650 A1 * 6/2012 Swallowe ..... G10K 11/172 181/295
2012/0181107 A1 7/2012 Hwang
2012/0247867 A1 * 10/2012 Yang ..... E04B 1/86 181/211
2013/0126268 A1 5/2013 Honji et al.
2014/0166391 A1 6/2014 Swallowe et al.
2016/0071507 A1 * 3/2016 Kim ..... G10K 11/172 181/286

FOREIGN PATENT DOCUMENTS

| | | |
|---|---|---|
| GB | 822954 | 11/1959 |
| GB | 2264316 | 8/1993 |
| JP | 2-85709 | 7/1990 |
| JP | 9-213541 | 8/1997 |
| JP | 2003-328326 | 11/2003 |
| JP | 2005-282321 | 10/2005 |
| JP | 2009-030432 | 2/2009 |
| JP | 2014-084578 | 5/2014 |
| KR | 10-1091855 | 12/2011 |

* cited by examiner

ACOUSTIC ATTENUATOR

This application is the U.S. national phase of International Application No. PCT/GB2015/050852 filed 23 Mar. 2015, which designated the U.S. and claims priority to GB Patent Application No. 1415874.5 filed 8 Sep. 2014, the entire contents of each of which are hereby incorporated by reference.

FIELD OF THE INVENTION

The invention relates to: acoustic attenuators; an acoustic attenuator system; apparatus comprising an acoustic attenuator; apparatus comprising an acoustic attenuator system; apparatus comprising an acoustic attenuator; and methods of attenuating acoustic waves.

BACKGROUND TO THE INVENTION

Environmental noise pollution is generated by many sources including traffic on roads, airports, construction sites, electrical substations, factories and school playgrounds. Such noise can be very disturbing for humans and animals, and can cause both psychological and physiological reactions. For these reasons, legislation against noise pollution has been enacted in many jurisdictions. Compliance with environmental legislation has, therefore, become a key issue in the development of new technologies in many industries.

Currently, acoustic barriers are used to attenuate noise. Such acoustic barriers are generally designed to absorb, reflect or otherwise attenuate the acoustic waves generated by a source. Acoustic barriers can be grouped into three main types.

Passive acoustic barriers generally comprise walls made of, for example, solid masonry or concrete. Such walls can be expensive to construct, they are often required to be very thick, and they may not attenuate low-frequency acoustic waves (which can be particularly irritating to humans) effectively.

Reactive acoustic attenuator elements are also known to attenuate acoustic waves through resonance effects. Such elements are more effective for low-frequency sound attenuation, and may provide attenuation across a resonant frequency band.

Sonic crystals, which typically comprise multiple rows of acoustic attenuator elements arranged periodically, are also known to attenuate acoustic waves through diffraction effects. However, the provision of multiple rows of acoustic elements requires a significant land footprint, which can be expensive particularly in built up areas.

Reactive acoustic elements can be arranged together to form an acoustic barrier in the form of a macroscopic sonic crystal in order to achieve attenuation of acoustic waves over different frequency bands or a stronger attenuation over a particular frequency band. However, it would be beneficial to reduce the land footprint of acoustic barriers which utilise these effects.

SUMMARY OF THE INVENTION

A first aspect of the invention provides an acoustic attenuator comprising: a (first) body defining a cavity therein and having at least one open aperture in fluid communication with the cavity; and opposing first and second walls, the second wall being substantially parallel to the first wall, the (first) body comprising at least one of the first and second walls, wherein the aperture and the cavity at least partly define a resonant frequency band across which the (first) body attenuates incident acoustic waves, and wherein the first and second walls are separated by a gap.

Typically incident acoustic waves are (typically multiply) scattered by the first and second walls. Typically the gap between the first and second walls is sized such that incident acoustic waves (having a particular frequency and angle of incidence) are (typically multiply) scattered by the first and second walls, the said scattered waves interfering with each other such that the said incident waves are thereby attenuated.

It may be that the first and second walls are parallel to each other, and the said incident acoustic waves have a frequency and an angle of incidence on the first and second walls satisfying the Bragg condition defined by the gap between the first and second walls such that the said scattered waves (typically destructively) interfere with each other, the said incident acoustic waves being thereby attenuated.

The first and second walls, and the gap extending between them, thus provide a finite one dimensional sonic crystal to incident acoustic waves having particular angles of incidence and frequencies (e.g. where the first and second walls are parallel, acoustic waves having angles of incidence and frequencies satisfying the Bragg condition defined by the gap between them).

By providing the acoustic attenuator with a body having a cavity and an open aperture at least partly defining a resonant frequency band across which the attenuator attenuates acoustic waves, and providing a gap between the first and second walls (such that incident acoustic waves (typically multiply) scattered by the first and second walls (typically destructively) interfere with each other such that said incident acoustic waves are thereby attenuated), two different mechanisms for acoustic attenuation (from the point of view of an observer on the opposite side of the acoustic attenuator from an acoustic wave source) are provided by the same acoustic attenuator. Synergy is achieved by virtue of the fact that the same (first) body defines the cavity and comprises the aperture and at least one of the first and second walls (and in some cases both the first and second walls—see below). The provision of first and second (substantially parallel) walls in the acoustic attenuator therefore removes the need to have a plurality of rows of acoustic attenuators in order to achieve a sonic crystal attenuation effect. This allows a single layer of acoustic attenuators to be provided which achieves both a local resonance-based acoustic wave attenuation effect and a one dimensional sonic crystal attenuation effect of incident acoustic waves.

It may be that the frequencies of acoustic waves attenuated by the two mechanisms are the same, but more typically the frequencies of acoustic waves attenuated by the two mechanisms are different. Nevertheless, it may be that there is some overlap between the said resonant frequency band and the frequencies of acoustic waves which are scattered by the first and second walls such that they (typically destructively) interfere with each other and are thereby attenuated. Accordingly, the acoustic attenuator can provide stronger acoustic attenuation (where the frequencies of acoustic waves attenuated by the two mechanisms are the same, or where there is some overlap between the resonant frequency band and the frequencies of acoustic waves which are scattered by the first and second walls such that they (typically destructively) interfere with each other and are thereby attenuated) of acoustic waves of a given frequency, or attenuation of acoustic waves of different frequencies (where the frequencies of acoustic waves attenuated by the two mechanisms are different). This provides the acoustic attenuator with greater flexibility, allowing better performance to be achieved.

It will be understood that the Bragg condition (in respect of the one dimensional sonic crystal effect provided by the first and second walls), which applies when the first and second walls are parallel to each other, is:

$$n\lambda=2d\sin(\alpha)$$

where:

n is an integer or a half-integer;

λ is the wavelength of the acoustic waves;

d is the shortest distance between the first and second walls;

and α is the angle of incidence of the incident acoustic waves on the first and second walls.

It will also be understood that the gap between the first and second walls defines the Bragg condition by way of parameter d.

It will be understood that, although the first and second walls are typically required to be parallel to each other for the Bragg condition to be satisfied, significant attenuation effects are still achieved when the first and second walls are not quite parallel to each other.

It may be that a transversal line extending between the first and second walls intersects the first and second walls with corresponding angles between the said transversal and the respective first and second walls differing from each other by 20° or less. Preferably, the corresponding angles between the said transversal and the respective first and second walls differ from each other by 10° or less, more preferably by 5° or less, more preferably 2.5° or less, more preferably 1° or less, even more preferably the corresponding angles between the said transversal and the respective first and second walls are the same.

Typically the sonic crystal attenuation effect (multiple scattering, interference and resultant attenuation of incident acoustic waves) provided by the first and second walls (and the said gap between them) attenuates incident acoustic waves over a band of frequencies and harmonics and subharmonics of the said band of frequencies.

Typically the gap between the first and second walls is sized such that acoustic waves having a frequency within the range 20 Hz to 20 kHz can have an angle of incidence on the first and second walls such that said acoustic waves which are (typically multiply) scattered by the first and second walls can (typically destructively) interfere with each other such that said incident acoustic waves are thereby attenuated. Typically the gap between the first and second walls is sized such that acoustic waves having a frequency within the range 20 Hz to 1 kHz can have an angle of incidence on the first and second walls such that said acoustic waves which are (typically multiply) scattered by the first and second walls can (typically destructively) interfere with each other such that said incident acoustic waves are thereby attenuated. Typically the gap between the first and second walls is sized such that acoustic waves having a frequency within the range 20 Hz to 500 Hz can have an angle of incidence on the first and second walls such that said acoustic waves which are (typically multiply) scattered by the first and second walls can (typically destructively) interfere with each other such that said incident acoustic waves are thereby attenuated.

Typically the first and second walls are (substantially) planar.

It will be understood that the first and second walls typically (multiply) scatter incident acoustic waves propagating in a direction having a component parallel to the line of shortest distance extending between the first and second walls such that said (multiply) scattered incident acoustic waves (e.g. where the first and second walls are parallel to each other, having a frequency and angle of incidence on the first and second walls satisfying the Bragg condition defined by the distance between them) (typically destructively) interfere with each other such that said incident acoustic waves are attenuated. A line of shortest distance extending between the first and second walls is typically substantially perpendicular to the first and second walls. A line of shortest distance extending between the first and second walls typically intersects the first and second walls.

Typically the open aperture and cavity at least partly define a resonant frequency band comprising one or more frequencies which lie within the range 20 Hz to 20 kHz. Typically the open aperture and cavity at least partly define a resonant frequency band comprising one or more frequencies which lie within the range 20 Hz to 1 kHz. Typically the open aperture and cavity at least partly define a resonant frequency band comprising one or more frequencies which lie within the range 20 Hz to 500 Hz.

Typically the (first) body comprises the first wall and the first wall comprises the open aperture. However, it will be understood that either the first or second walls may comprise the (indeed each of the first and second walls may comprise a respective) open aperture.

It may be that the first wall comprises first and second co-planar wall portions separated by the open aperture.

In some embodiments the (first) body comprises the first and second walls.

In this case, the (first) body itself attenuates acoustic waves by the two different (local resonance and one dimensional sonic crystal) attenuation mechanisms discussed above.

Typically the (first) body is elongate. Typically the (first) body has a longitudinal axis extending along its length.

Typically the first and second walls have widths (perpendicular to the longitudinal axis of the body and to the line of shortest distance between the first and second walls) which are greater than the width (or greater than twice the width) of the open aperture.

The (first) body typically comprises first and second ends. It may be that the first and/or second ends are closed, but typically the first and second ends are open.

It may be that the (first) body has a cross section perpendicular to its longitudinal axis which is trapezoidal. Typically the cavity defined by the (first) body has a cross section perpendicular to its longitudinal axis which is trapezoidal.

The (first) body (and typically the cavity defined by the (first) body) may have a cross section perpendicular to its longitudinal axis which is quadrilateral (for example it is parallelogrammatical, square or rectangular), hexagonal or octogonal. Indeed the (first) body (and typically the cavity defined by the (first) body) may have a cross section perpendicular to its longitudinal axis of any other suitable shape.

Typically the (first) body is monolithic. Typically the (first) body is tubular. Typically the (first) body comprises an outer surface and an inner surface opposite the outer surface, the inner surface defining the cavity. Typically the open aperture extends through the (first) body to fluidly connect the outer surface of the (first) body and the cavity. Fluid can typically flow into and out of the cavity through the open aperture without obstruction. Typically the (first) body is (at least substantially) hollow.

Typically the said resonant frequency band is at least partly defined by a length (typically parallel to the longitudinal axis of the body) and/or a width (perpendicular to the length) and/or depth of the open aperture.

It may be that the (first) body further comprises a neck. Typically the neck extends from the edge(s) of the open aperture into and/or away from the cavity. It may be that the said resonant frequency band is at least partly defined by the length of the neck. The length of the neck is typically substantially perpendicular to the first and second walls.

It may be that the width of the open aperture varies along its length.

Typically the said resonant frequency band is at least partly defined by a volume of the cavity.

Typically the said open aperture has a length which extends along at least 50%, more preferably at least 75%, more preferably at least 90%, most preferably 100% of the length of the (first) body (parallel to a longitudinal axis of the body). Typically the said open aperture is elongate.

It may be that the aperture comprises a plurality of discrete apertures extending along a length of the (first) body (parallel to a longitudinal axis of the body). It may be that the plurality of discrete apertures are spaced from each other. It may be that (solid) portions of the (first) body extend between the plurality of discrete apertures. It may be that each of the plurality of discrete apertures is elongate. The combined aperture length of said discrete apertures may extend along at least 50%, more preferably at least 75%, most preferably at least 90% of the length of the (first) body (parallel to a longitudinal axis of the body). This also applies to the second bodies discussed below. It may be that a line extending in a direction parallel to a longitudinal axis of the (first) body extends across each of the said plurality of open apertures. It may be that the apertures of the said plurality of open apertures are aligned with each other along the length of the (first) body. Typically the said plurality of apertures together form an elongate aperture area.

It may be that the acoustic attenuator comprises a plurality of (first) bodies, each of the plurality of (first) bodies defining a cavity therein and having: at least one open aperture in fluid communication with the cavity; opposing first and second walls, the second wall being substantially parallel to the first wall, wherein the aperture and the cavity at least partly define a resonant frequency band across which it attenuates incident acoustic waves, and wherein the first and second walls are separated by a gap.

Typically incident acoustic waves are (typically multiply) scattered by the first and second walls of each of the said plurality of (first) bodies. Typically the gap between the first and second walls of each of the said plurality of (first) bodies is sized such that incident acoustic waves (having a particular frequency and angle of incidence) are (typically multiply) are scattered by the first and second walls, the said scattered waves interfering with each other such that the said incident waves are thereby attenuated.

Preferably, the first and second walls are parallel to each other, and the said incident acoustic waves have a frequency and an angle of incidence on the first and second walls satisfying the Bragg condition defined by the gap between the first and second walls such that the said incident waves (typically destructively) interfere with each other, the said incident acoustic waves being thereby attenuated.

It may be that the said open aperture of the said (first) body of the said acoustic attenuator is a first of first and second open apertures in fluid communication with the cavity defined by the said (first) body of the acoustic attenuator, the said first and second open apertures being offset from each other around the longitudinal axis of the said (first) body (e.g. offset around the perimeter of the said (first) body of the acoustic attenuator in a direction having a component perpendicular to the longitudinal axis of the said (first) body of the said acoustic attenuator).

By providing first and second open apertures in fluid communication with the cavity defined by the said body, the said first and second open apertures being offset from each other around the longitudinal axis of the said (first) body, two masses of fluid will resonate within the cavity (as a result of fluid being able to flow into and out of the cavity through the first and second apertures) when acoustic waves having a frequency within the resonant frequency band of the said body are incident on the attenuator, thereby significantly increasing the acoustic attenuation provided by the attenuator as compared to an attenuator having a cavity of the same volume with only one of the first and second apertures. In addition, the first open aperture can resonantly couple the said cavity of the said body to the cavity of a first adjacent ("nearest neighbour") attenuator and the second open aperture can resonantly couple the said cavity of the said body to the cavity of a second adjacent ("nearest neighbour") attenuator (e.g. different from the first adjacent attenuator). This helps to improve the resonance coupling effect between attenuators per unit volume (the said cavity of the said body being resonantly coupled to the cavities of two adjacent attenuators), which increases the level of attenuation provided. This also helps to broaden the frequency range of attenuation provided.

It may be that the first and second open apertures are provided (e.g. directly) opposite each other. It may be that the first and second open apertures of the (first) body face each other (and are typically in fluid communication with each other). It may be that the (first) body comprises first and second (typically planar) faces which are opposite each other, and it may be that the first face comprises the first open aperture and the second face comprises the second open aperture. It may be that the first and second open apertures are provided directly opposite each other (typically such there is at least some overlap (preferably a complete overlap) between the first and second open apertures in a direction parallel to the line of shortest distance between the first and second faces). The symmetry provided by having the first and second open apertures directly opposite each other helps to optimise the resonance (and thus acoustic attenuation) performance of the said (first) body of the attenuator.

Typically a plurality of the said plurality of (first) bodies are provided next to each other. Typically the said plurality of (first) bodies are provided outside each other.

It may be that a plurality of the said plurality of (first) bodies are arranged together (e.g. periodically) in a row. It may be that one or more (first) bodies of the row are provided with opposing first and second walls which are spaced apart by a first distance and one or more (first) bodies of the row are provided with opposing first and second walls which are spaced apart by a second distance different from the first distance, the first and second distances defining different frequencies at (or frequency bands across) which the first and second walls of those bodies scatter incident acoustic waves such that the said scattered acoustic waves interfere with each other and are thereby attenuated.

It may be that adjacent (first) bodies are separated from each other by a gap.

It may be that a plurality of the said plurality of (first) bodies are fixedly attached to a frame extending between them.

It may be that a plurality of the said plurality of (first) bodies are fixedly coupled to each other (e.g. fastened or clamped to a frame extending between them or to each other, or moulded together) to form a panel.

It may be that a plurality of the plurality of (first) bodies are arranged together (e.g. periodically) to form an acoustic barrier. The acoustic barrier may comprise a single layer of the (first) bodies.

It may be that a plurality of the plurality of (first) bodies are arranged together to form an enclosure. The enclosure may comprise a single layer of the (first) bodies. The enclosure formed by the said plurality of (first) bodies may be a two sided enclosure, more preferably a three sided enclosure, a four sided enclosure, a five sided enclosure or a six sided enclosure. It may be that one of the sides of the enclosure comprises a roof. It may be that one of the sides of the enclosure comprises a floor.

It may be that the plurality of (first) bodies are arranged together in a two dimensional array.

It may be that the (first) bodies of the plurality of (first) bodies are arranged periodically. For example, the (first) bodies of the plurality of (first) bodies may be arranged to form at least one row, the distance between adjacent (first) bodies in the row being periodic (e.g. the spacing between adjacent (first) bodies being identical or varying periodically).

The (first) bodies of the plurality of (first) bodies may be arranged in a plurality of (typically substantially parallel) rows, the distance between adjacent rows being periodic. Subsequent adjacent rows of (first) bodies are typically spaced from each other such that incident acoustic waves having a particular frequency and angle of incidence are (typically multiply) scattered by the subsequent rows, the said scattered waves interfering with each other such that the said incident waves are thereby attenuated.

Preferably, the (e.g. planes defined by the) rows are parallel to each other, and incident acoustic waves having a frequency and angle of incidence which satisfies a Bragg condition defined by the spacing between the rows (e.g. the spacing between adjacent rows, or the planes defined by the rows, being identical or varying periodically) are (typically multiply) scattered by the subsequent rows, the said scattered waves (typically destructively) interfering with each other such that the said incident waves are thereby attenuated.

It may be that each of the plurality of (first) bodies is provided with substantially the same resonant frequency band (e.g. at least 50%, preferably at least 80% of each resonant frequency band is common to the other resonant frequency bands). Alternatively, it may be that a first group of the said plurality of (first) bodies is provided with a first resonant frequency band and a second group of the said plurality of (first) bodies is provided with a second resonant frequency band different from the first resonant frequency band. Alternatively, each of the plurality of (first) bodies is provided with a different resonant frequency band.

It may be that the gaps between the first and second walls of each of the plurality of (first) bodies are the same (e.g. when the first and second walls are parallel to each other, the gaps between the first and second walls of each of the plurality of (first) bodies may be sized to provide substantially the same Bragg condition). Alternatively, it may be that the gaps between the first and second walls of a first group of the said plurality of (first) bodies are different from the gaps between the first and second walls of a second group of the said plurality of (first) bodies different from the first group (e.g. when the first and second walls of each of the first group of (first) bodies are parallel to each other, the gaps between the first and second walls of each of the said first group of (first) bodies may be sized to provide a first Bragg condition, and when the first and second walls of each of the second group of (first) bodies are parallel to each other, the gaps between the first and second walls of each of the said second group of (first) bodies may be sized to provide a second Bragg condition different from the first Bragg condition). Alternatively, it may be that the gaps between the first and second walls of each of the said plurality of (first) bodies are different (e.g. where the first and second walls of each of the plurality of (first) bodies are parallel to each other, the gaps between the first and second walls of each of the plurality of (first) bodies may be sized to provide different Bragg conditions).

It may be that opposing first and second rows are provided, each comprising two or more (first) bodies. It may be that one or more (or each) of the (first) bodies of the first row are provided with opposing first and second walls which are spaced apart by a first distance and one or more (or each) of the (first) bodies of the second row are provided with opposing first and second walls which are spaced apart by a second distance different from the first distance, the first and second distances defining different frequencies (or frequency bands) across which the first and second walls of those attenuators scatter incident acoustic waves such that the said scattered acoustic waves interfere with each other and are thereby attenuated.

It may be that the acoustic attenuator further comprises a second body (typically discrete from the (first) body). It may be that the second body comprises the second wall.

Typically the second body is provided next to the first body. For example, the first and second bodies may be arranged together in a row. Typically the first and second bodies are spaced apart from each other. For example, the first and second bodies may be arranged in a row with a gap between them. Typically the first and second bodies are provided opposite each other. Typically the first and second bodies are provided outside each other.

The second body is typically elongate. Typically the second body is tubular. Typically the second body is monolithic. The second body typically defines a cavity and comprises an open aperture in fluid communication with the cavity, the aperture and cavity at least partly defining a resonant frequency band across which the second body attenuates acoustic waves.

Typically the second body comprises an outer surface and an inner surface opposite the outer surface, the inner surface defining the cavity. Typically the open aperture of the second body extends through the second body to fluidly connect the outer surface of the second body and the cavity. Typically the second body is (at least substantially) hollow. Typically fluid can flow into and out of the cavity of the second body through the open aperture of the second body (typically without obstruction).

The second body typically has first and second ends. It may be that the first and second ends are closed but typically the first and second ends are open.

The first and second bodies may be provided with triangular cross sections perpendicular to their longitudinal axes.

It may be that the acoustic attenuator comprises a plurality of pairs of first and second bodies. It may be that the first body of each of the plurality of pairs comprising the first wall and the second body of each of the plurality of pairs comprising the second wall. Typically the first and second bodies of each pair are identical to each other (although it may be that the first and second bodies of each pair are oriented differently from each other). Typically the first and second bodies of each pair are provided with at least partially overlapping resonant frequency bands. Typically the first and second bodies of each pair are provided with substantially the same resonant frequency bands (e.g. at least 50%, preferably at least 80% of each resonant frequency band is common to the other resonant frequency bands).

It may be that the first and second bodies of a first pair of first and second bodies are provided with a first resonant frequency band and the first and second bodies of a second pair of first and second bodies are provided with a second resonant frequency band different from the first resonant frequency band.

It may be that the plurality of pairs of first and second bodies are arranged together (e.g. periodically) to form at least one row.

It may be that a plurality of pairs of first and second bodies are fixedly attached to a frame extending between them.

It may be that a plurality of pairs of first and second bodies are fixedly coupled to each other (e.g. fastened or clamped to a frame extending between them or to each other, or moulded) to form a panel.

It may be that a plurality of pairs of first and second bodies are arranged together (e.g. periodically) to form an acoustic barrier.

It may be that a plurality of pairs of first and second bodies are arranged together to form an enclosure. The enclosure may comprise a single layer of the pairs of first and second bodies. The enclosure formed by the said plurality of pairs of first and second bodies may be a two sided enclosure, more preferably a three sided enclosure, a four sided enclosure, a five sided enclosure or a six sided enclosure. It may be that one of the sides of the enclosure comprises a roof. It may be that one of the sides of the enclosure comprises a floor.

It may be that the plurality of pairs of first and second bodies are arranged together in a two dimensional array.

It may be that the pairs of first and second bodies of the plurality of pairs of first and second bodies are arranged periodically (e.g. the distance between adjacent (first) bodies may be identical along the row or it may vary periodically). For example, the pairs of first and second bodies of the plurality of pairs of first and second bodies may be arranged to form at least one row, the distance between adjacent pairs of first and second bodies in the row being periodic.

The pairs of first and second bodies of the plurality of pairs of first and second bodies may be arranged in a plurality of rows, the distance between adjacent rows being periodic (e.g. the distance between adjacent rows may be identical or it may vary periodically). Subsequent rows are typically spaced from each other such that incident acoustic waves having a particular frequency and angle of incidence are (typically multiply) scattered by the subsequent rows, the said scattered waves interfering with each other such that the said incident waves are thereby attenuated.

Preferably, when the subsequent rows (or the planes defined by the rows) are parallel to each other, incident acoustic waves having a frequency and angle of incidence which satisfies a Bragg condition defined by the spacing between the rows (e.g. the spacing between adjacent rows, or between the planes defined by the rows, being identical or varying periodically) are (typically multiply) scattered by the subsequent rows, the said scattered waves (typically destructively) interfering with each other such that the said incident waves are thereby attenuated.

The acoustic attenuator is (e.g. the (first) body and, where provided, the second body are) typically provided in a fluidic host medium. For example, the host medium may comprise air. The fluidic host medium typically fills the cavity and surrounds the (first) body. The gap between the first and second walls of the (first) body (and where provided the second body) typically comprises the fluidic host medium (e.g. the gap typically comprises air). The (first) body (and, where provided, the second body) is typically formed from a solid material. It will be understood that this provides a first density mismatch between the first wall and the gap and a second density mismatch between the gap and the second wall.

Typically the "resonant frequency band" at least partly defined by the cavity and the open aperture of a body is a band of frequencies of acoustic waves which stimulate resonance of the fluidic host medium (e.g. air) in the cavity. Accordingly, the resonant frequency band is typically substantially independent of the material forming the body (although there may be a weak dependence of the resonant frequency band on the material forming the body).

By the aperture being "open", we mean that fluid (of the fluidic host medium) is able to enter and leave the cavity through the aperture (typically from and to the fluid host medium surrounding the body, typically without obstruction).

A second aspect of the invention provides an acoustic attenuator system (or apparatus) comprising: a first acoustic attenuator according to the first aspect of the invention; and a second acoustic attenuator according to the first aspect of the invention (the bodies of the first and second attenuators typically being discrete from each other), wherein one or more open apertures of the first acoustic attenuator (or a plurality of discrete open apertures of the first acoustic attenuator, e.g. discrete open apertures which are spaced from each other along the length of the (first) body of the first acoustic attenuator, typically aligned with each other along the length of the (first) body of the first acoustic attenuator) face(s) one or more open apertures of the second acoustic attenuator (or a plurality of discrete open apertures of the second acoustic attenuator, e.g. discrete open apertures which are spaced from each other along the length of the (first) body of the second acoustic attenuator, typically aligned with each other along the length of the (first) body of the first acoustic attenuator) and a gap is provided between the said open apertures (the said apertures typically being in fluid communication with each other), and typically between the bodies of the attenuators. Typically the gap is sized such that resonance of fluid within the cavity of the (first) body of the first attenuator can stimulate resonance of fluid within the cavity of the (first) body of the second attenuator (and typically vice versa), at least when the resonance occurs at a frequency within the said resonant frequency bands of both the first and second attenuators.

It may be that a or the (first) body of the first acoustic attenuator is provided with a resonant frequency band which at least partially overlaps with (or is identical to) a resonant frequency band of a or the (first) body of the second acoustic attenuator. Typically a (first) body of the first acoustic attenuator defines a cavity and comprises an open aperture in fluid communication with the cavity, and a (first) body of the second acoustic attenuator defines a cavity and comprises an open aperture in fluid communication with the cavity, the open aperture of the said (first) body of the first acoustic attenuator facing (and typically being in fluid communication with) the open aperture of the said (first) body of the second acoustic attenuator, the said open apertures and cavities of the (first) bodies of the first and second acoustic attenuators at least partly defining respective resonant frequency bands across which the (first) bodies of the first and second acoustic attenuators attenuate acoustic waves, the said resonant frequency bands at least partially overlapping with (or being substantially identical to) each other.

It may be that the (first) bodies of the first and second attenuators are identical to each other (although the (first) bodies of the first and second attenuators are typically oriented differently from each other).

It may be that the first and second acoustic attenuators are identical to each other (although they may be oriented differently from each other).

Typically the first and second acoustic attenuators are oriented differently from each other.

By arranging the open apertures such that they face each other, a strong resonance coupling is achieved between the first and second attenuators, thereby achieving a stronger acoustic attenuation effect particularly for acoustic waves having frequencies in the resonant frequency bands of the bodies of the first and second acoustic attenuators whose open apertures face each other.

Typically the first and second walls of the first acoustic attenuator are substantially parallel to the first and second walls of the second acoustic attenuator. Typically there is a direct line of sight between the apertures of the first and second acoustic attenuator which face each other.

Typically resonance of a fluid (e.g. air) within the cavity (e.g. caused by incident acoustic waves) of a or the (first) body of the first acoustic attenuator whose aperture is facing an aperture of a or the (first) body of the second acoustic attenuator stimulates resonance of a fluid (e.g. air) within the cavity of the said (first) body of the second acoustic attenuator (and vice versa), at least when the resonance occurs at a frequency within the said resonant frequency bands of the first and second attenuators (thereby attenuating said incident acoustic waves).

Typically a gap is provided between the first and second acoustic attenuators. The smaller the gap, the better the resonance coupling effect between the acoustic attenuators. However, a gap should be maintained between the first and second attenuators to allow incident acoustic waves to enter and exit the cavities of the (first) bodies of the first and second attenuators by way of their open apertures.

Typically the first and second attenuators are provided next to each other (rather than, for example, one of the acoustic attenuators being provided inside the other). Typically the second acoustic attenuator is provided downstream of the first acoustic attenuator (e.g. with respect to an acoustic wave source which emits acoustic waves having one or more frequencies within the resonant frequency bands of the first and/or second attenuators). Typically the first and second acoustic attenuators are provided outside each other. Typically the first and second attenuators are provided opposite each other.

Preferably, the shortest distance between the (first) bodies of the first and second attenuators whose open apertures face each other is less than ten times the mean spacing between the first and second walls of the said (first) body of the first attenuator and less than ten times the mean spacing between the first and second walls of the said (first) body of the second attenuator. Preferably, the shortest distance between the (first) bodies of the first and second attenuators whose open apertures face each other is less than five times the mean spacing between the first and second walls of the said (first) body of the first attenuator and less than five times the mean spacing between the first and second walls of the said (first) body of the second attenuator. Preferably, the shortest distance between the (first) bodies of the first and second attenuators whose open apertures face each other is less than two times the mean spacing between the first and second walls of the said (first) body of the first attenuator and less than two times the mean spacing between the first and second walls of the said (first) body of the second attenuator.

Preferably the first and second walls of the first attenuator are parallel to each other. Preferably the first and second walls of the second attenuator are parallel to each other. Preferably the first and second walls of the first attenuator are parallel to the first and second walls of the second attenuator.

Preferably the shortest distance between the (first) bodies of the first and second attenuators whose open apertures face each other is equal to the shortest distance between the first and second walls of the said (first) body of the first attenuator and/or equal to the shortest distance between the first and second walls of the said (first) body of the second attenuator. More generally, in some cases, the spacing between the first and second walls of the first acoustic attenuator, the spacing between the first and second walls of the second acoustic attenuator and a spacing between the first and second acoustic attenuators are the same. It may be that two or more (e.g. three or more) of the first and second walls of the first attenuator and the first and second walls of the second attenuator are arranged periodically so as to attenuate acoustic waves over a resonant frequency band (typically by (e.g. multiply) scattering acoustic waves emitted by an acoustic wave source, the said scattered waves (typically destructively) interfering with each other such that the said incident acoustic waves are thereby attenuated). This improves the sonic crystal attenuation effect provided by the substantially parallel first and second walls of the (e.g. (first) body of the) first attenuator and/or by the substantially parallel first and second walls of the (e.g. (first) body of the) second attenuator.

By the open apertures of the first and second acoustic attenuators facing each other, we mean that there is at least some overlap (preferably a complete overlap) between the open apertures of the first and second attenuators in a direction parallel to the line of shortest distance between the first and second attenuators. A line of shortest distance between a centre of the (first) body comprising a or the said open aperture of the first acoustic attenuator and a centre of the (first) body comprising the open aperture of the second acoustic attenuator facing the said open aperture of the first acoustic attenuator typically passes through both said open apertures. Thus, fluid resonating in the cavity of the (first) body comprising a or the said open aperture of the first acoustic attenuator can stimulate resonance of fluid provided in the cavity of the (first) body comprising a or the said open aperture of the second acoustic attenuator (at least when the resonance occurs at a frequency within the said resonant frequency bands of the first and second attenuators). The open apertures of other acoustic attenuators (or bodies of acoustic attenuators) facing each other should be interpreted accordingly.

Typically the (first) bodies of the first and second attenuators are provided with at least partially overlapping (or identical) resonant frequency bands.

It may be that one of the first and second walls of the first acoustic attenuator is spaced from one of the first and second walls of the second attenuator such that incident acoustic waves (e.g. of a particular frequency and angle of incidence) scattered by the said walls (typically destructively) interfere with each other and are thereby attenuated.

For example, it may be that the first wall of the first acoustic attenuator is spaced from the second wall of the second acoustic attenuator, and that the first wall of the first acoustic attenuator and the second wall of the second acoustic attenuator scatter incident acoustic waves (e.g. of a particular frequency and angle of incidence) such that the said scattered acoustic waves (typically destructively) interfere with each other such that the said incident waves are thereby attenuated.

Typically the said one of the first and second walls of the first attenuator and the said one of the first and second walls of the second attenuator are substantially parallel to each other.

It may be that one of the first and second walls of the first acoustic attenuator is parallel to one of the first and second walls of the second acoustic attenuator, wherein the said one of the first and second walls of the first acoustic attenuator is spaced from the said one of the first and second walls of the second attenuator such that incident acoustic waves having a frequency and angle of incidence on the said walls satisfying a Bragg condition defined by the spacing between them are scattered by the said walls, the said scattered acoustic waves (typically destructively) interfering with each other such that said incident acoustic waves are thereby attenuated.

For example, it may be that the first wall of the first acoustic attenuator is parallel to the second wall of the second acoustic attenuator, the first wall of the first acoustic attenuator being spaced from the second wall of the second acoustic attenuator, the first wall of the first acoustic attenuator and the second wall of the second acoustic attenuator scattering incident acoustic waves having a frequency and angle of incidence on the said walls satisfying the Bragg condition defined by the spacing between them (typically destructively) such that they interfere with each other and the said incident acoustic waves are thereby attenuated.

It may be that the acoustic attenuator system comprises a plurality of said pairs of first and second acoustic attenuators, wherein the said open aperture of the first acoustic attenuator of each pair faces (and is typically in fluid communication with) a corresponding open aperture of the second acoustic attenuator of that pair.

It may be that a plurality of the said pairs of first and second acoustic attenuators are arranged together (e.g. periodically) to form an acoustic barrier. The acoustic barrier may comprise a single layer of the said pairs of first and second acoustic attenuators.

It may be that a plurality of the said pairs of first and second acoustic attenuators are arranged together to form an enclosure. The enclosure may comprise a single layer of the said pairs of first and second acoustic attenuators. The enclosure formed by the said plurality of pairs of first and second acoustic attenuators may be a two sided enclosure, more preferably a three sided enclosure, a four sided enclosure, a five sided enclosure or a six sided enclosure. It may be that one of the sides of the enclosure comprises a roof. It may be that one of the sides of the enclosure comprises a floor.

It may be that the acoustic attenuator system comprises a third said acoustic attenuator (the body of the third attenuator typically being discrete from the bodies of the first and second attenuators) wherein the (first) body of each of the said first and third acoustic attenuators comprises a first face and a second face, the first face comprising the said open aperture of that body, and wherein the (first) bodies of the said first and third attenuators are arranged such that their second faces are adjacent to each other and that fluid can flow into or out of the cavities of the said first and third attenuators of the said pair through their respective open apertures.

It will be understood that the third attenuator may be provided without the said second attenuator, or in combination with said a second attenuator which does not have a resonant frequency band which overlaps that of the first attenuator. That is, the second aspect of the invention also extends to an acoustic attenuator system (or apparatus) comprising: a first acoustic attenuator according to the first aspect of the invention; and a second acoustic attenuator according to the first aspect of the invention, wherein the (first) body of each of the said first and second acoustic attenuators comprises a first face and a second face, the first face comprising the said open aperture of that body, and wherein the (first) bodies of the said first and second attenuators are arranged such that their second faces are adjacent to each other and that fluid can flow into or out of the cavities of the said first and second attenuators of the said pair through their respective open apertures. References to the first and third attenuators below may be considered to be references to the first and second attenuators of this acoustic attenuator system.

By the second faces of the bodies of the first and third attenuators being adjacent to each other we mean that the second face of the first body is provided closer to second face of the third body than to the first face of the third body (and vice versa). This arrangement helps to increase the number of attenuators per unit volume. Where resonance coupling is provided between adjacent attenuators, this also helps to optimise the resonance coupling effect between attenuators per unit volume, which increases the level of attenuation provided by the attenuators. This also helps to broaden the frequency range of attenuation.

Typically the first and second faces of each of the said attenuators are separated by a gap.

Typically the first and second faces of the said bodies of the first and third attenuators are planar faces. Typically the first and second faces of the said bodies of the first and third attenuators are substantially parallel to each other. Typically the second faces of the first and third attenuators abut each other. Typically the second faces of the first and third attenuators are mechanically coupled to each other.

Typically the first and third attenuators are provided next to each other (rather than, for example, one of the attenuators being provided inside the other). Typically the first and third attenuators are provided outside each other. Typically the first and third attenuators are provided opposite each other. It may be that the (first) bodies of the first and third attenuators are identical to each other, but oriented at 180° to each other.

It may be that the first and third attenuators have at least partially overlapping resonant frequency bands. It may be that the first and third attenuators have different resonant frequency bands. It may be that the first and third attenuators have resonant frequency bands which do not overlap. It may be that the bodies of the first and third attenuators have the same shapes. It may be that the bodies of the first and third attenuators are identical to each other (albeit they may be oriented differently from each other, for example at 180° to each other). It may be that the bodies of the first and third attenuators have the same shapes but different sizes. It may be that the bodies of the first and third attenuators have different shapes. It may be that the second face of the body of the first attenuator (typically completely) overlaps the second face of the body of the third attenuator, and it may be that the second face of the body of the first attenuator extends beyond the second face of the body of the third attenuator.

It may be that the first and third attenuators are first and third attenuators of a first pair of first and third attenuators. It may be that one or more further pairs of said first and third attenuators are arranged (e.g. periodically) together with the said first pair of first and third attenuators in a row. It may be that the first attenuator of the first pair is provided adjacent to the third attenuator of a second pair within the said row. It may be that the first attenuator of the first pair is provided adjacent to the first attenuator of a second pair within the said row.

It may be that the first and third attenuators of the first pair each have a first resonant frequency band (and typically the bodies of the first and third attenuators of the first pair have the same shape and typically the same size as each other). It may be that the first and third attenuators of the second pair each have a second resonant frequency band different from the first resonant frequency bands (and typically the bodies of the first and third attenuators of the second pair have the same shape and typically the same size as each other). It may be that the bodies of the first and third attenuators of the second pair have different sizes and/or shapes from the first and third attenuators of the first pair.

It may be that the second attenuator is a first or third attenuator of the said second pair of first and third attenuators.

It may be that the attenuator system comprises first and second rows of said pairs of first and third attenuators. It may be that the pairs of first and third attenuators within each of the first and second rows are arranged periodically. It may be that the first and second rows are first and second rows of a plurality of rows of said pairs of first and third attenuators, the said rows being arranged (e.g. periodically) so as to attenuate acoustic waves (e.g. emitted by an acoustic wave source) over a further (e.g. resonant) frequency band.

It may be that a said attenuator of each pair in the second row is provided opposite (and may abut and may be mechanically coupled to and may face and may be downstream of, with respect to acoustic waves emitted by an acoustic wave source) an attenuator of a said pair of the first row.

It may be that the attenuators of the first row are provided with the same or (more typically) different resonant frequency bands from those of the respective attenuators of the second row which they are provided opposite.

It may be that the open apertures of each said pair of the first row face away from (e.g. at 90° to) the pair of the second row provided opposite the said pair of the first row. It may be that the open apertures of each said pair of the second row face away from (e.g. at 90° to) the pair of the first row provided opposite the said pair of the second row.

It may be that the first and second rows are separated by a gap.

It may be that the first faces of the bodies of the attenuators of the first row are not flush with the first faces of the bodies of the attenuators of the second row they are provided opposite. For example, the first faces of the bodies of the attenuators of the second row may be set back from the first faces of the bodies of the attenuators of the first row which they are provided opposite. Alternatively it may be that the first faces of the bodies of the attenuators of the first row are flush with the first faces of the bodies of the attenuators of the second row they are provided opposite. It may be that the second faces of the bodies of the attenuators of one or more or each said pair of bodies of the first row abut each other, while the second faces of the attenuators of one or more or each said pair of bodies of the attenuators of the second row are separated by a gap. For example, it may be that the first and second faces of the bodies of one or both of the attenuators of each said pair of the second row are separated by a smaller gap than the first and second faces of the bodies of one or both of the attenuators of the said pair of the first row which they are provided opposite, and the second faces of the bodies of one or more or each said pair of attenuators of the second row are separated by a gap so that the first faces of the said bodies of the said pair of attenuators of the second row are flush with the first faces of the said bodies of the said pair of attenuators of the first row which they are provided opposite.

It may be that the opposing first and second walls of the bodies of the attenuators of one or more or each of the said pairs of the first and third attenuators of the first row are separated by a first gap and that the opposing first and second walls of the bodies of the attenuators of one or more or each of the said pairs of the first and third attenuators of the second row which are provided opposite the said one or more or each of the said pairs of the first and third attenuators of the first row are separated by a second gap different from the first gap. Accordingly it may be that the first and second walls of the said pairs of the first row are configured to scatter incident acoustic waves of a first frequency (or within a first frequency band) such that the said incident acoustic waves interfere with each other and are thereby attenuated. It may be that the first and second walls of the said pairs of the second row provided opposite the said pairs of the first row are configured to scatter incident acoustic waves of a second frequency (or within a second frequency band) different from the first frequency (or from the first frequency band) such that the said incident acoustic waves interfere with each other and are thereby attenuated. It may be that the frequency bands across which the first and second walls of the first and second rows attenuate acoustic waves by this mechanism partially overlap, but it may be that they do not overlap.

It may be that the acoustic attenuator system further comprises a fourth said acoustic attenuator (the body of the third attenuator typically being discrete from the bodies of the first, second and third attenuators) having a said open aperture in fluid communication with, and facing, the said open aperture of the third acoustic attenuator, the bodies of the said third and fourth acoustic attenuators at least partly defining at least partially overlapping resonant frequency bands and a gap being provided between the open apertures of the said third and fourth acoustic attenuators (and typically between the third and fourth attenuators), the gap being sized such that resonance of fluid within the cavity of the said third acoustic attenuator can stimulate resonance of fluid within the cavity of the said fourth acoustic attenuator.

Preferably, the gap between the bodies of the third and fourth attenuators is less than ten times the longest dimension of the said cross sections of the bodies of the third and/or fourth attenuators. Preferably, the gap between the said bodies is less than five times the longest dimension of the said cross sections of the bodies of the third and/or fourth attenuators. Preferably, the gap between the bodies is less than two times the longest dimension of the said cross sections of the bodies of the third and/or fourth attenuators.

It may be that the fourth attenuator is a first or third attenuator of a third pair of said first and third attenuators, the third pair being adjacent to the first pair of first and third attenuators within the said row.

It may be that the second and third pairs are identical to the first pair.

It may be that the acoustic attenuator system further comprises a fifth said acoustic attenuator (the body of the fifth attenuator typically being discrete from the bodies of the first, second, third and fourth attenuators). It may be that the bodies of the second and fifth attenuators each comprise a first face and a second face, the first face comprising the said open aperture of that body, and wherein the bodies of the second and fifth attenuators are arranged such that their second faces are adjacent to each other and that fluid can fluid into or out of the cavities defined by the bodies of the second and fifth attenuators through their respective open apertures (typically without the other body causing an obstruction thereto). It may be that the fifth attenuator is the other of the first and third attenuators of the said second pair.

It may be that the acoustic attenuator system further comprises a sixth said attenuator (the body of the sixth attenuator typically being discrete from the bodies of the first, second, third, fourth and fifth attenuators). It may be that the bodies of the fourth and sixth attenuators each comprise a first face and a second face, the first face comprising the said open aperture of that body, and wherein the bodies of the fourth and sixth attenuators are arranged such that their second faces are adjacent to each other and that fluid can fluid into or out of the cavities defined by the bodies of the fourth and sixth attenuators through their respective open apertures (typically without the other body causing an obstruction thereto). It may be that the sixth attenuator is the other of the first and third attenuators of the said third pair.

It will be understood that the open apertures of one or more or each of the first, second, third, fourth, fifth and sixth attenuators (where provided) may be elongate open apertures. Where provided, the elongate open apertures may extend along at least a portion of (e.g. at least 30% of, at least 40% of, at least 50% of, at least 90% of) the, or along the entire, length of the (first) body (typically parallel to the longitudinal axis) comprising that elongate open aperture. It may be that the open apertures of one or more or each of the first, second, third, fourth, fifth and sixth attenuators (where provided) are open apertures of respective groups of discrete open apertures (each group comprising two or more open apertures) provided on the (first) body of each said attenuator and arranged such that a line extending in a direction parallel to a longitudinal axis of the said (first) body extends across each of the apertures within the group. Typically the apertures within each group of apertures are aligned with each other along the length of the said (first) body. The said plurality of discrete open apertures within each group (where provided) may comprise a combined aperture length extending along, for example, at least 30% of, at least 40% of, at least 50% of or at least 90% of the length of the (first) body (parallel to the longitudinal axis of the (first) body). Typically the said plurality of discrete open apertures within each group (where provided) together form an elongate aperture area.

It may be that the acoustic attenuator system comprises a plurality of groups of said first, second, third and fourth (and typically fifth and sixth) acoustic attenuators. It may be that a plurality of the said groups are arranged together (e.g. periodically) to form an acoustic barrier. The acoustic barrier may comprise a single layer of the said groups.

It may be that a plurality of groups of said first, second, third and fourth (and typically fifth and sixth) acoustic attenuators are arranged together to form an enclosure. The enclosure may comprise a single layer of the said groups. The enclosure may be a two sided enclosure, more preferably a three sided enclosure, a four sided enclosure, a five sided enclosure or a six sided enclosure. It may be that one of the sides of the enclosure comprises a roof. It may be that one of the sides of the enclosure comprises a floor.

It may be that the said open aperture of the said (first) body of the first and/or second said acoustic attenuator is a first of first and second open apertures in fluid communication with the cavity defined by the said (first) body, the said first and second open apertures being offset from each other around the longitudinal axis of the said (first) body (e.g. offset around the perimeter of the said (first) body in a direction having a component perpendicular to the longitudinal axis of the said (first) body.

By providing first and second open apertures in fluid communication with the cavity defined by the said body, the said first and second open apertures being offset from each other around the longitudinal axis of the said (first) body, two masses of fluid will resonate within the cavity (as a result of fluid being able to flow into and out of the cavity through the first and second apertures) when acoustic waves having a frequency within the resonant frequency band of the said body are incident on the attenuator, thereby significantly increasing the acoustic attenuation provided by the attenuator as compared to an attenuator having a cavity of the same volume with only one of the first and second apertures. In addition, the first open aperture can resonantly couple the said cavity of the said body to the cavity of a first adjacent ("nearest neighbour") attenuator and the second open aperture can resonantly couple the said cavity of the said body to the cavity of a second adjacent ("nearest neighbour") attenuator (e.g. different from the first adjacent attenuator). This helps to improve the resonance coupling effect between attenuators per unit volume (the said cavity of the said body being resonantly coupled to the cavities of two adjacent attenuators), which increases the level of attenuation provided. This also helps to broaden the frequency range of attenuation provided.

It will be understood that one or both of the first and second open apertures may be elongate open apertures. Where provided, the elongate open apertures may extend along at least a portion of (e.g. at least 30% of, at least 40% of, at least 50% of, at least 90% of) the, or along the entire, length of the (first) body (typically parallel to the longitudinal axis). It may be that the one or both of the first and second open apertures are open apertures of respective groups of discrete open apertures (each group comprising two or more open apertures) provided on the said (first) body and arranged such that a line extending in a direction parallel to a longitudinal axis of the said (first) body extends across each of the apertures within the group. Typically the apertures within each group of apertures are aligned with each other along the length of the said (first) body. The said plurality of discrete open apertures within each group (where provided) may comprise a combined aperture length extending along, for example, at least 30% of, at least 40% of, at least 50% of or at least 90% of the length of the (first) body (parallel to the longitudinal axis of the (first) body). Typically the said plurality of discrete open apertures within each group (where provided) together form an elongate aperture area. It may be that two or more or each of the said plurality of open apertures are in fluid communication with each other (e.g. through the cavity of the said (first) body).

It may be that the first and second open apertures are in fluid communication with each other (e.g. through the cavity of the said (first) body).

It may be that the first and second open apertures are provided (e.g. directly) opposite each other. It may be that the first and second open apertures of the (first) body face each other (and are typically in fluid communication with each other). It may be that the (first) body comprises first and second (typically planar) faces which are opposite each other, and it may be that the first face comprises the first open aperture and the second face comprises the second open aperture. It may be that the first and second open apertures are provided directly opposite each other (typically such there is at least some overlap (preferably a complete overlap) between the first and second open apertures in a direction parallel to the line of shortest distance between the first and second faces). The symmetry provided by having the first and second open apertures directly opposite each other helps to optimise the resonance (and thus acoustic attenuation) performance of the said (first) body of the attenuator.

It may be that the first said open aperture is in fluid communication with, and faces, a said open aperture of the second said acoustic attenuator. It may be that the second said open aperture is in fluid communication with, and faces, a said open aperture of third said acoustic attenuator. It may be that the (first) body of the first attenuator defines a resonant frequency band which at least partially overlaps with resonant frequency bands defined by the (first) bodies of the said second and/or third attenuators (where provided). It may be that gaps are provided between the first and second said open apertures and the said open apertures of the second and third attenuators (where provided). It may be that the gaps are sized such that resonance of fluid in the cavity defined by the body of the said first attenuator can stimulate resonance of fluid within the cavities of the said second and third attenuators (at least when the resonance occurs at a frequency within the said resonant frequency bands of the said cavities).

By providing the (first) body of the first attenuator with first and second open apertures which resonantly couple the first cavity to the cavities of adjacent attenuators, the resonance coupling effect between attenuators per unit volume is increased, which increases the level of attenuation provided by the attenuators. This also helps to broaden the frequency range of attenuation.

Typically the first attenuator is provided next to the said second and third attenuators (rather than any of the attenuators being inside another). Typically the said first attenuator is provided opposite the said second attenuator and opposite the third attenuator. Typically the said first attenuator and the said second and third attenuators are provided outside each other.

It may be that the acoustic attenuator system comprises a plurality of groups of said first, second and third acoustic attenuators. It may be that a plurality of the said groups are arranged together (e.g. periodically, e.g. in a row) to form an acoustic barrier. The acoustic barrier may comprise a single layer of the said groups.

It may be that a plurality of groups of said first, second and third acoustic attenuators are arranged together to form an enclosure. The enclosure may comprise a single layer of the said groups. The enclosure may be a two sided enclosure, more preferably a three sided enclosure, a four sided enclosure, a five sided enclosure or a six sided enclosure. It may be that one of the sides of the enclosure comprises a roof. It may be that one of the sides of the enclosure comprises a floor.

It may be that the acoustic attenuator system comprises first and second rows of first, second and third (and typically further said) attenuators. It may be that the attenuators within each row are arranged periodically. It may be that the first and second rows are first and second rows of a plurality of rows, the said rows being arranged (e.g. periodically) so as to attenuate acoustic waves (e.g. emitted by the acoustic wave source) over a further (e.g. resonant) frequency band.

It may be that one or more or each of the said attenuators in the second row is provided opposite (and may abut and may be mechanically coupled to and may face and may be downstream of, with respect to acoustic waves emitted by the acoustic wave source) a respective attenuator of the first row. It may be that the attenuators of the first row are provided with the same or (more typically) different resonant frequency bands from those of the respective attenuators of the second row which they are provided opposite.

It may be that the first and second open apertures of said attenuator of the first row face away from (e.g. at 90° to) the attenuator of the second row provided opposite the said attenuator of the first row. It may be that the first and second open apertures of each said attenuator of the second row face away from (e.g. at 90° to) the attenuator of the first row provided opposite the said attenuator of the second row.

It may be that the first and second rows are separated by a gap.

It may be that the first faces of the bodies of the attenuators of the first row are not flush with the first faces of the bodies of the attenuators of the second row they are provided opposite. For example, the first faces of the bodies of the attenuators of the second row may be set back from the first faces of the bodies of the first row which they are provided opposite. Alternatively it may be that the first faces of the bodies of the attenuators of the first row are flush with the first faces of the bodies of the attenuators of the second row they are provided opposite.

A third aspect of the invention provides apparatus comprising: an acoustic wave source which emits acoustic waves (in use); and an acoustic attenuator according to the first aspect of the invention provided in an acoustic wave propagation path of acoustic waves emitted by the acoustic wave source, wherein the acoustic wave source emits acoustic waves having a frequency within the said resonant frequency band, and acoustic waves which are (typically multiply) scattered by the first and second walls, the said scattered waves (typically destructively) interfering with each other such that the said incident acoustic waves are thereby attenuated.

For example, it may be that the first and second walls are parallel to each other, and that the acoustic wave source emits acoustic waves having a frequency and being incident on the first and second walls with an angle of incidence satisfying the said Bragg condition defined by the gap between the first and second walls.

Typically one of the first and second walls is downstream from the other of the first and second walls with respect to the said acoustic waves emitted by the acoustic wave source.

It will be understood that the acoustic wave source may comprise a single source of acoustic waves or a plurality of different sources of acoustic waves which emit acoustic waves of the same or different frequencies.

It may be that a plurality of (first) bodies are provided.

It may be that a plurality of the plurality of (first) bodies are arranged together (e.g. periodically) to form an acoustic barrier in the said acoustic propagation path of acoustic waves emitted by the acoustic wave source. The acoustic barrier may comprise a single layer of the (first) bodies.

It may be that a plurality of the plurality of (first) bodies are arranged together to form an enclosure comprising the acoustic wave source. The enclosure may comprise a single layer of the (first) bodies. The enclosure formed by the said plurality of (first) bodies may be a two sided enclosure, more preferably a three sided enclosure, a four sided enclosure, a five sided enclosure or a six sided enclosure. It may be that one of the sides of the enclosure comprises a roof. It may be that one of the sides of the enclosure comprises a floor.

It may be that (typically the first and second walls are parallel to each other, and) the shortest distance between the first and second walls is equal to a wavelength of acoustic waves emitted by the acoustic wave source.

It may be that (typically the first and second walls are parallel to each other, and) the shortest distance between the first and second walls is substantially equal to an integer number or a half-integer number of wavelengths of acoustic waves emitted by the acoustic wave source.

It may be that the apparatus comprises a plurality of attenuators according to the first aspect of the invention (e.g. arranged to form an acoustic barrier or an enclosure) in the acoustic propagation path of the said acoustic waves emitted by the acoustic wave source. Typically, the acoustic wave source emits acoustic waves having a frequency within the said resonant frequency bands of each of the said plurality of attenuators, and acoustic waves which are (typically multiply) scattered by the first and second walls of each of the said plurality of attenuators, the said scattered waves (typically destructively) interfering with each other such that the said incident acoustic waves are thereby attenuated.

Typically the acoustic attenuator(s) are provided within a radius of 100 metres of the acoustic wave source, more preferably within a radius of 50 metres of the acoustic wave source, even more preferably within a radius of 10 metres of the acoustic wave source, and most preferably within a radius of 1 metre of the acoustic wave source. Typically the attenuation of acoustic waves is more effective the closer the acoustic attenuators are to the acoustic wave source.

A fourth aspect of the invention provides apparatus comprising: an acoustic wave source which emits acoustic waves; and an acoustic attenuator system according to the second aspect of the invention provided in an acoustic wave propagation path of acoustic waves emitted by the said acoustic wave source, wherein the acoustic wave source emits acoustic waves having a frequency within the said resonant frequency bands of the (first) bodies of the first and second acoustic attenuators, and acoustic waves which are (typically multiply) scattered by the first and second walls of the first acoustic attenuator, the said scattered waves (typically destructively) interfering with each other such that the said incident acoustic waves are thereby attenuated.

For example, it may be that the first and second walls of the first acoustic attenuator are parallel to each other, and it may be that the acoustic wave source emits acoustic waves having a frequency and being incident on the first and second walls of the first acoustic attenuator with an angle of incidence satisfying the Bragg condition defined by the gap between the first and second walls of the first acoustic attenuator.

Typically one of the first and second walls of each of the said attenuators of the acoustic attenuator system is downstream from the other of the first and second walls of that attenuator with respect to the said acoustic waves emitted by the acoustic wave source.

It may be that the acoustic wave source emits acoustic waves having a frequency within the said resonant frequency bands of the bodies of the third and/or fourth and/or fifth and/or sixth acoustic attenuators, where provided.

It may be that a plurality of pairs of first and second attenuators is provided. It may be that the said pairs of first and second bodies are arranged (e.g. periodically) next to each other to form a row. It may be that a plurality of the said pairs of first and second attenuators are arranged together (e.g. periodically) to form an acoustic barrier. The acoustic barrier may comprise a single layer of the said pairs of first and second attenuators. It may be that the said row extends perpendicularly to an acoustic wave propagation path of acoustic waves emitted by the acoustic wave source.

It may be that a plurality of the pairs of first and second attenuators are arranged together to form an enclosure comprising the acoustic wave source. The enclosure may comprise a single layer of the said pairs of first and second attenuators. The enclosure formed by the said plurality of first and second attenuators may be a two sided enclosure, more preferably a three sided enclosure, a four sided enclosure, a five sided enclosure or a six sided enclosure. It may be that one of the sides of the enclosure comprises a roof. It may be that one of the sides of the enclosure comprises a floor.

Where the acoustic attenuator system comprises a plurality of rows of said attenuators (each row comprising a plurality of attenuators) it may be that the said rows are arranged (e.g. periodically) so as to attenuate incident acoustic waves emitted by the acoustic wave source across a further (e.g. resonant) frequency band.

Where the acoustic attenuator system comprises first and second rows of acoustic attenuators it may be that the second row is provided downstream of the first row with respect to acoustic waves emitted by the acoustic wave source.

It may be that a plurality of groups of first, second and third (and/or fourth and/or fifth and/or sixth) said acoustic attenuators is provided. It may be that the said groups of attenuators are arranged next to each other (e.g. periodically) to form a row. It may be that a plurality of the said groups of attenuators are arranged together (e.g. periodically) to form an acoustic barrier. The acoustic barrier may comprise a single layer of the said groups of attenuators.

It may be that a plurality of groups of said first, second and third (and/or fourth and/or fifth and/or sixth) acoustic attenuators are arranged together to form an enclosure comprising the acoustic wave source. The enclosure may comprise a single layer of the said groups of attenuators. The enclosure formed by the said plurality of the said groups may be a two sided enclosure, more preferably a three sided enclosure, a four sided enclosure, a five sided enclosure or a six sided enclosure. It may be that one of the sides of the enclosure comprises a roof. It may be that one of the sides of the enclosure comprises a floor.

Preferably, the acoustic wave source emits acoustic waves having frequencies and being incident on the first and second walls of the second acoustic attenuator (and typically of one or more or each of the third, fourth, fifth and sixth acoustic attenuator, where provided) which are (typically multiply) scattered by the first and second walls of the second acoustic attenuator, the said scattered waves (typically destructively) interfering with each other such that the said incident acoustic waves are thereby attenuated.

For example, it may be that the first and second walls of the second acoustic attenuator are parallel to each other, and it may be that the acoustic wave source emits acoustic waves having frequencies and being incident on the first and second walls of the second acoustic attenuator having a frequency and angle of incidence satisfying the Bragg conditions defined by the gap between the first and second walls of the second acoustic attenuator.

It will be understood that the acoustic wave source may comprise a single source of acoustic waves or a plurality of different sources of acoustic waves which emit acoustic waves of the same or different frequencies.

Typically the acoustic wave source emits acoustic waves incident on one of the first and second walls of the first acoustic attenuator and on one of the first and second walls of the second acoustic attenuator, the said one of the first and second walls of the first acoustic attenuator being spaced from the said one of the first and second walls of the second attenuator such that the said one of the first and second walls of the first attenuator and the said one of the first and second walls of the second attenuator scatter incident acoustic waves which are (typically multiply) scattered by the said walls, the said scattered waves (typically destructively) interfering with each other such that the said incident acoustic waves are thereby attenuated.

For example, it may be that one of the first and second walls of the first acoustic attenuator is parallel to one of the first and second walls of the second acoustic attenuator, and it may be that the acoustic wave source emits acoustic waves incident on said one of the first and second walls of the first acoustic attenuator and on said one of the first and second walls of the second acoustic attenuator, the said one of the first and second walls of the first acoustic attenuator being spaced from the said one of the first and second walls of the second attenuator such that the said one of the first and second walls of the first attenuator and the said one of the first and second walls of the second attenuator scatter incident acoustic waves having a frequency and an angle of incidence satisfying a Bragg condition defined by the spacing between them, the said scattered acoustic waves (typically destructively) interfering with each such that said incident acoustic waves are thereby attenuated.

Typically the resonant frequency bands of the (first) bodies of the first and second attenuators (and typically of the (first) bodies of the third and/or fourth and/or fifth and/or sixth acoustic attenuators where provided) comprise one or more frequencies of acoustic waves emitted by the acoustic wave source. It may be that a or the (first) body of the first acoustic attenuator is provided with a resonant frequency band which at least partially overlaps with (or is identical to) a resonant frequency band of a or the (first) body of the second acoustic attenuator, the said overlapping portion of the resonant frequency bands comprising a frequency of acoustic waves emitted by the acoustic wave source. Typically a (first) body of the first acoustic attenuator defines a cavity and comprises an open aperture in fluid communication with the cavity, and a (first) body of the second acoustic attenuator defines a cavity and comprises an open aperture in fluid communication with the cavity, the open aperture of the said (first) body of the first acoustic attenuator facing (and typically being in fluid communication with) the open aperture of the said (first) body of the second acoustic attenuator, the said open apertures and cavities of the (first) bodies of the first and second acoustic attenuators at least partly defining resonant frequency bands over which the (first) bodies attenuate acoustic waves, the said resonant frequency bands at least partially overlapping with (or are identical to) each other. Typically the at least partially overlapping portions of the resonant frequency bands comprise one or more frequencies of acoustic wave emitted by the acoustic wave source.

It may be that resonance of a fluid (e.g. air or other fluidic host medium) within the cavity of a or the (first) body of the first acoustic attenuator stimulates resonance of a fluid (e.g. air or other fluidic host medium) within the cavity of a or the (first) body of the second acoustic attenuator (e.g. within the cavity of the (first) body of the second acoustic attenuator whose open aperture faces (and is typically in fluid communication with) the open aperture of the said (first) body of the first acoustic attenuator).

It may be that the (first) bodies of the first and second attenuators are identical to each other (although the (first) bodies of the first and second attenuators are typically oriented differently from each other).

It may be that the first and second acoustic attenuators are identical to each other (although it may be that they are oriented differently from each other).

It may be that the (first) body of the first acoustic attenuator is provided with a resonant frequency band which at least partially overlaps with (or is identical to) a resonant frequency band of a or the (first) body of the third acoustic attenuator (where provided), the said overlapping portion of the resonant frequency bands comprising a frequency of acoustic waves emitted by the acoustic wave source.

It may be that the (first) body of the third acoustic attenuator (where provided) is provided with a resonant frequency band which at least partially overlaps with (or is identical to) a resonant frequency band of a or the (first) body of the fourth acoustic attenuator (where provided), the said overlapping portion of the resonant frequency bands comprising a frequency of acoustic waves emitted by the acoustic wave source.

Typically the acoustic attenuator system is provided within a radius of 100 metres of the acoustic wave source, more preferably within a radius of 50 metres of the acoustic wave source, even more preferably within a radius of 10 metres of the acoustic wave source, and most preferably within a radius of 1 metre of the acoustic wave source. Typically the attenuation of acoustic waves is more effective the closer the acoustic attenuator system is to the acoustic wave source.

A fifth aspect of the invention provides an acoustic attenuator comprising: a first body defining a cavity therein and having at least one open aperture in fluid communication with the cavity, the cavity and the at least one open aperture at least partly defining a first resonant frequency band across which the first body attenuates acoustic waves; and a second body (typically discrete from the first body) defining a cavity therein and having at least one open aperture in fluid communication with the cavity, the cavity and the at least one open aperture at least partly defining a second resonant frequency band across which the second body attenuates acoustic waves, wherein the open apertures of the first and second bodies face each other (and are typically in fluid communication with each other) and wherein the first and second resonant frequency bands at least partially overlap.

Typically a gap is provided between the said open apertures of the first and second bodies (and typically between the first and second bodies). Typically the gap is sized such that resonance of fluid within the cavity of the body can stimulate resonance of fluid within the cavity of the second body (and typically vice versa), at least when the resonance occurs at a frequency within the said resonant frequency bands of both the first and second bodies.

Typically the first body is oriented differently from the second body.

Typically the first and second bodies are provided next to each other (rather than, for example, one of the bodies being provided inside the other). Typically the second body is provided downstream of the first body (e.g. with respect to an acoustic wave source which emits acoustic waves having one or more frequencies within the resonant frequency bands of the first and/or second bodies). Typically the first and second bodies are provided outside each other. Typically the first and second bodies are provided opposite each other. It may be that the first and second bodies are identical to each other, but oriented at 180° to each other.

By arranging the open apertures such that they face each other, a strong resonance coupling is achieved between the first and second bodies, thereby achieving a stronger acoustic attenuation effect for acoustic waves having frequencies in the first and second resonant frequency bands. This allows a fewer number of bodies to be provided to achieve a required attenuation. For example, it may be that the acoustic attenuator is provided as part of an acoustic barrier comprising a plurality of said acoustic attenuators arranged in one or more rows. Fewer rows are required to achieve a required acoustic attenuation than if the apertures did not face each other.

Typically the first and second bodies have cross sections perpendicular to their longitudinal axes. Preferably, the gap between the first and second bodies is less than ten times the longest dimension of the said cross sections of the first and/or second bodies. Preferably, the gap between the first and second bodies is less than five times the longest dimension of the said cross sections of the first and/or second bodies. Preferably, the gap between the first and second bodies is less than two times the longest dimension of the said cross sections of the first and/or second bodies.

By the open apertures of the first and second bodies facing each other, we mean that there is at least some overlap (preferably a complete overlap) between the open apertures of the first and second bodies in a direction parallel to the line of shortest distance between the first and second attenuators. A line of shortest distance between a centre of the first body and a centre of the second body typically passes through both said open apertures. Thus, fluid resonating in the cavity of the first body can stimulate resonance of fluid provided in the cavity of the second body (at least when the resonance occurs at a frequency within the said resonant frequency bands of the first and second bodies).

It may be that the first and second resonant frequency bands are identical. Typically a gap is provided between the open apertures of the first and second acoustic attenuators (and typically between the first and second attenuators).

It may be that a plurality of pairs of said first and second bodies are arranged together (e.g. periodically) to form an acoustic barrier. The acoustic barrier may comprise a single layer of the said pairs of first and second bodies.

It may be that a plurality of the pairs of first and second bodies are arranged together to form an enclosure. The enclosure may comprise a single layer of the said pairs of first and second bodies. The enclosure formed by the said plurality of pairs of first and second bodies may be a two sided enclosure, more preferably a three sided enclosure, a four sided enclosure, a five sided enclosure or a six sided enclosure. It may be that one of the sides of the enclosure comprises a roof. It may be that one of the sides of the enclosure comprises a floor.

It may be that the acoustic attenuator further comprises a third body (typically discrete from the first and second bodies) defining a cavity therein and having at least one open aperture in fluid communication with the cavity, the cavity and the at least one open aperture at least partly defining a third resonant frequency band across which the third body attenuates acoustic waves, wherein each of the first and third bodies comprise a first face and a second face, the first face comprising the said open aperture of that body, and wherein the first and third bodies are arranged such that their second faces are adjacent to each other and that fluid can fluid into or out of the cavities defined by the first and third bodies through their respective open apertures (typically without the other body causing an obstruction thereto).

By the second faces of first and third bodies being adjacent to each other we mean that the second face of the first body is provided closer to second face of the third body than to the first face of the third body (and vice versa).

This arrangement helps to optimise the resonance coupling effect between attenuators per unit volume, which increases the level of attenuation provided by the attenuators. This also helps to broaden the frequency range of attenuation.

Typically the third body is discrete from the first and second bodies.

Typically the first and second faces of each of the said first and third bodies are separated by a gap.

Typically the first and second faces of the said first and third bodies are planar faces. Typically the first and second faces of the said first and third bodies are substantially parallel to each other. Typically the second faces of the said first and third bodies abut each other. Typically the second faces of the attenuators of the first and third bodies are mechanically coupled to each other.

Typically the first and third bodies are provided next to each other (rather than, for example, one of the bodies being provided inside the other). Typically the first and third bodies are provided outside each other. Typically the first and third bodies are provided opposite each other. It may be that the first and third bodies are identical to each other, but oriented at 180° to each other.

It may be that the acoustic attenuator comprises a plurality of pairs of first and third bodies arranged (e.g. periodically) together in a row, or in multiple rows, for example as described below in respect of the eleventh aspect of the invention (it being understood that the third body is referred to as the second body with respect to the eleventh aspect).

It may be that the acoustic attenuator comprises a fourth body (typically discrete from the first, second and third bodies) defining a cavity therein and having at least one open aperture in fluid communication with the cavity, the cavity and the at least one open aperture at least partly defining a fourth resonant frequency band across which the fourth body attenuates acoustic waves, wherein the said open aperture of the fourth body is in fluid communication with, and faces, the said open aperture of the third body, the third and fourth resonant frequency bands at least partially overlapping, and a gap being provided between the said open apertures of the third and fourth bodies (and typically between the third and fourth bodies), the gap being sized such that resonance of fluid within the cavity of the third body can stimulate resonance of fluid within the cavity of the fourth body (at least when the resonance occurs at a frequency within the said resonant frequency bands of the said third and fourth bodies).

Typically the third and fourth bodies have cross sections perpendicular to their longitudinal axes. Preferably, the gap between the third and fourth bodies is less than ten times the longest dimension of the said cross sections of the third and/or fourth bodies. Preferably, the gap between the third and fourth bodies is less than five times the longest dimension of the said cross sections of the third and/or fourth bodies. Preferably, the gap between the third and fourth bodies is less than two times the longest dimension of the said cross sections of the third and/or fourth bodies.

Typically the fourth body is discrete from the first, second and third bodies.

Typically the third and fourth bodies are provided next to each other (rather than, for example, one of the bodies being provided inside the other). Typically the third and fourth bodies are provided outside each other. Typically the third and fourth bodies are provided opposite each other. It may be that the third and fourth bodies are identical to each other, but oriented at 180° to each other.

Typically the said overlapping portions of the third and fourth resonant frequency bands comprise one or more frequencies of acoustic waves emitted by the said acoustic wave source.

It may be that the acoustic attenuator comprises a fifth body (typically discrete from the first, second, third and fourth bodies) defining a cavity therein and having at least one open aperture in fluid communication with the cavity, the cavity and the at least one open aperture at least partly defining a fifth resonant frequency band across which the fifth body attenuates acoustic waves.

It may be that the second and fifth bodies each comprise a first face and a second face, the first face comprising the said open aperture of that body, and wherein the second and fifth bodies are arranged such that their second faces are adjacent to each other and that fluid can fluid into or out of the cavities defined by the second and fifth bodies through their respective open apertures (typically without the other body causing an obstruction thereto).

It may be that the acoustic attenuator comprises a sixth body (typically discrete from the first, second, third, fourth and fifth bodies) defining a cavity therein and having at least one open aperture in fluid communication with the cavity, the cavity and the at least one open aperture at least partly defining a sixth resonant frequency band across which the sixth body attenuates acoustic waves.

It may be that the fourth and sixth bodies each comprise a first face and a second face, the first face comprising the said open aperture of that body, and wherein the fourth and sixth bodies are arranged such that their second faces are adjacent to each other and that fluid can fluid into or out of the cavities defined by the fourth and sixth bodies through their respective open apertures (typically without the other body causing an obstruction thereto).

It will be understood that the open apertures of one or more or each of the first, second, third, fourth, fifth and sixth bodies (where provided) may be elongate open apertures. Where provided, the elongate open apertures of each said body may extend along at least a portion of (e.g. at least 30% of, at least 40% of, at least 50% of, at least 90% of) the, or along the entire, length of the said body (typically parallel to the longitudinal axis). It may be that the open apertures of one or more or each of the first, second, third, fourth, fifth and sixth bodies (where provided) are open apertures of respective groups of discrete open apertures (each group comprising two or more open apertures) provided on the said body and arranged such that a line extending in a direction parallel to a longitudinal axis of the said body extends across each of the apertures within the group. Typically the apertures within each group of apertures are aligned with each other along the length of the said body. The said plurality of discrete open apertures within each group (where provided) may comprise a combined aperture length extending along, for example, at least 30% of, at least 40% of, at least 50% of or at least 90% of the length of the said body (parallel to the longitudinal axis of the (first) body). Typically the said plurality of discrete open apertures within each group (where provided) together form an elongate aperture area.

It may be that the said open aperture of the first body is the first of first and second open apertures of the first body which are in fluid communication with the cavity of the first body, the said first and second open apertures of the first body being offset from each other around the longitudinal axis of the said first body (e.g. offset around the perimeter of the first body in a direction having a component perpendicular to the longitudinal axis of the said first body).

By providing first and second open apertures in fluid communication with the cavity defined by the first body, the said first and second open apertures being offset from each other around the longitudinal axis of the said first body, two masses of fluid will resonate within the cavity (as a result of fluid being able to flow into and out of the cavity through the first and second apertures) when acoustic waves having a frequency within the resonant frequency band of the said first body are incident on the first body, thereby significantly increasing the acoustic attenuation provided by the first body as compared to body having a cavity of the same volume with only one of the first and second apertures. In addition, the first open aperture can resonantly couple the said cavity of the said body to the cavity of a first adjacent ("nearest neighbour") body and the second open aperture can resonantly couple the said cavity of the said body to the cavity of a second adjacent ("nearest neighbour") body (e.g. different from the first adjacent body). This helps to improve the resonance coupling effect between bodies per unit volume (the said cavity of the said body being resonantly coupled to the cavities of two adjacent bodies), which increases the level of attenuation provided. This also helps to broaden the frequency range of attenuation provided.

It will be understood that one or both of the first and second open apertures may be elongate open apertures. Where provided, the elongate open apertures may extend along at least a portion of (e.g. at least 30% of, at least 40% of, at least 50% of, at least 90% of) the, or along the entire, length of the (first) body (typically parallel to the longitudinal axis). It may be that the one or both of the first and second open apertures are open apertures of respective groups of discrete open apertures (each group comprising two or more open apertures) provided on the said (first) body and arranged such that a line extending in a direction parallel to a longitudinal axis of the said (first) body extends across each of the apertures within the group. Typically the apertures within each group of apertures are aligned with each other along the length of the said (first) body. The said plurality of discrete open apertures within each group (where provided) may comprise a combined aperture length extending along, for example, at least 30% of, at least 40% of, at least 50% of or at least 90% of the length of the (first) body (parallel to the longitudinal axis of the (first) body). Typically the said plurality of discrete open apertures within each group (where provided) together form an elongate aperture area.

It may be that the first and second open apertures are in fluid communication with each other (e.g. through the cavity of the said (first) body).

It may be that the first and second apertures are provided (e.g. directly) opposite each other. It may be that the first and second open apertures of the (first) body face each other. It may be that the (first) body comprises first and second (typically planar) faces which are opposite each other, and it may be that the first face comprises the first open aperture and the second face comprises the second open aperture.

It may be that the first and second open apertures of the said first body are provided directly opposite each other (typically such there is at least some overlap (preferably a complete overlap) between the first and second open apertures in a direction parallel to the line of shortest distance between the first and second faces).

It may be that the acoustic attenuator comprises a plurality of said bodies comprising first and second open apertures arranged (e.g. periodically) together in a row, or in multiple rows, for example as described below in respect of the tenth aspect of the invention.

The acoustic attenuator may further comprise a third body defining a cavity therein and having at least one open aperture in fluid communication with the cavity, the cavity and the at least one open aperture at least partly defining a third resonant frequency band across which the third body attenuates acoustic waves, wherein the said open aperture of the third body is in fluid communication with, and faces, the second open aperture of the first body, wherein the first and third resonant frequency bands at least partially overlap, and a gap is provided between the second open aperture of the first body and the said open aperture of the third body, the gap being sized such that resonance of fluid within the cavity of the first body can stimulate resonance of fluid within the cavity of the third body (at least when the resonance occurs at a frequency within the said resonant frequency bands of the said first and third bodies).

By providing the first body with first and second open apertures which resonantly couple the first cavity to the cavities of adjacent attenuators, the resonance coupling effect between attenuators per unit volume is increased, which increases the level of attenuation provided by the attenuators. This also helps to broaden the frequency range of attenuation.

Preferably, the gap between the bodies of the first and third attenuators is less than ten times the longest dimension of the said cross sections of the bodies of the first and/or third attenuators. Preferably, the gap between the said bodies is less than five times the longest dimension of the said cross sections of the bodies of the first and/or third attenuators. Preferably, the gap between the bodies is less than two times the longest dimension of the said cross sections of the bodies of the first and/or third attenuators.

Typically the first body is provided next to the said third body (rather than one of the bodies being inside the other). Typically the first body is provided opposite the said third body. Typically the first and third bodies are provided outside each other. It may be that the first and third bodies are identical to each other.

It may be that the open apertures of one or both of the second and third bodies are each first of the first and second open apertures of that body which are in fluid communication with the cavity of that body, the said first and second open apertures of that body being offset from each other around the longitudinal axis of that body (e.g. offset around the perimeter of that body in a direction having a component perpendicular to the longitudinal axis of that body).

It may be that a plurality of said acoustic attenuators are provided (e.g. arranged together in one or more rows). It may be that a plurality of the said acoustic attenuators are arranged together (e.g. periodically) to form an acoustic barrier. The acoustic barrier may comprise a single layer of the said acoustic attenuators.

It may be that a plurality of said acoustic attenuators are arranged together to form an enclosure. The enclosure may comprise a single layer of the said acoustic attenuators. The enclosure may be a two sided enclosure, more preferably a three sided enclosure, a four sided enclosure, a five sided enclosure or a six sided enclosure. It may be that one of the sides of the enclosure comprises a roof. It may be that one of the sides of the enclosure comprises a floor.

A sixth aspect of the invention provides apparatus comprising:

an acoustic wave source which emits acoustic waves; and an acoustic attenuator comprising: a first body defining a cavity therein and having at least one open aperture in fluid communication with the cavity, the cavity and the at least one open aperture at least partly defining a first resonant frequency band across which the first body attenuates acoustic waves; and a second body defining a cavity therein and having at least one open aperture in fluid communication with the cavity, the cavity and the at least one open aperture at least partly defining a second resonant frequency band across which the second body attenuates acoustic waves, wherein the open apertures of the first and second bodies face each other (and are typically in fluid communication with each other) and the first and second resonant frequency bands at least partially overlap, wherein (typically the overlapping portions of) the first and second resonant frequency bands comprise one or more frequencies of acoustic waves emitted by the acoustic wave source.

The acoustic attenuator may have any or all of the features of the acoustic attenuator according to any other aspect of the invention disclosed herein. In particular, the acoustic attenuator may comprise any combination of the features of the acoustic attenuator of the fifth aspect of the invention.

Typically the acoustic attenuator is provided in an acoustic wave propagation path of acoustic waves emitted by the source. In particular, as discussed above in respect of the fifth aspect of the invention, the attenuator may further comprise a third body, in some cases also a fourth body, in some cases also a fifth body and in some cases also a sixth body. Typically the resonant frequency bands of the third, fourth, fifth and sixth bodies (where provided) comprise one or more frequencies of acoustic waves emitted by the acoustic wave source. Typically the overlapping portions of the resonant frequency bands of adjacent bodies comprise one or more frequencies of acoustic waves emitted by the acoustic wave source.

Typically the acoustic attenuator is provided within a radius of 100 metres of the acoustic wave source, more preferably within a radius of 50 metres of the acoustic wave source, even more preferably within a radius of 10 metres of the acoustic wave source, and most preferably within a radius of 1 metre of the acoustic wave source. Typically the attenuation of acoustic waves is more effective the closer the acoustic attenuator is to the acoustic wave source.

Typically the first and second resonant frequency bands comprise one or more of the same frequencies of acoustic waves emitted by the acoustic wave source.

Typically the first body is oriented differently from the second body.

Typically the first and second bodies are provided next to each other (rather than, for example, one of the bodies being provided inside the other). Typically the second body is provided downstream of the first body (e.g. with respect to the acoustic wave source). Typically the first and second acoustic attenuators are provided outside each other. Typically the first and second attenuators are provided opposite each other.

It may be that a plurality of pairs of said first and second bodies are arranged together (e.g. periodically) to form an acoustic barrier. The acoustic barrier may comprise a single layer of the said pairs of first and second bodies. Typically the acoustic barrier is provided in the acoustic wave propagation path of acoustic waves emitted by the acoustic wave source.

It may be that a plurality of the pairs of first and second bodies are arranged together to form an enclosure comprising the acoustic wave source. The enclosure may comprise a single layer of the said pairs of first and second bodies. The enclosure formed by the said plurality of pairs of first and second bodies may be a two sided enclosure, more preferably a three sided enclosure, a four sided enclosure, a five sided enclosure or a six sided enclosure. It may be that one of the sides of the enclosure comprises a roof. It may be that one of the sides of the enclosure comprises a floor. Typically the enclosure is provided in the acoustic wave propagation path of acoustic waves emitted by the acoustic wave source.

A seventh aspect of the invention provides a method of attenuating acoustic waves emitted by an acoustic wave source, the method comprising: acoustic waves emitted by the acoustic wave source stimulating resonance of a fluid provided within a cavity defined by a (first) body comprising an open aperture in fluid communication with the cavity; and first and second walls scattering acoustic waves emitted by the acoustic wave source, the said scattered acoustic waves interfering with each other such that the said incident acoustic waves are thereby attenuated.

Typically the first and second walls are substantially parallel to each other.

Typically the method comprises the first and second walls scattering acoustic waves emitted by the acoustic wave source, the said acoustic waves having a frequency and an angle of incidence upon the first and second walls which satisfy a Bragg condition defined by a gap provided between the first and second walls, the said (first) body comprising at least one of the first and second walls. Typically the said first and second walls are parallel to each other.

It may be that the said open aperture of the (first) body of the said attenuator is the first of first and second open apertures of the (first) body which are in fluid communication with the cavity of the first body, the said first and second open apertures of the (first) body being offset from each other around the longitudinal axis of the said (first) body (e.g. offset around the perimeter of the (first) body in a direction having a component perpendicular to the longitudinal axis of the said (first) body). It may be that the method further comprises incident acoustic waves stimulating resonance of fluid within the cavity of the (first) body through the first and second apertures to thereby attenuate the said incident acoustic waves.

An eighth aspect of the invention provides a method of attenuating acoustic waves emitted by an acoustic wave source, the method comprising: acoustic waves emitted by the acoustic wave source stimulating resonance of a fluid provided within a first cavity defined by a first body comprising a first open aperture in fluid communication with the first cavity; and acoustic waves emitted by the acoustic wave source stimulating resonance of a fluid provided within a second cavity defined by a second body comprising a second open aperture in fluid communication with the second cavity, wherein the first and second open apertures face each other such that resonance of the fluid provided within the first cavity caused by the said acoustic waves stimulates resonance of the fluid provided within the second cavity.

Typically the first body is oriented differently from the second body.

Typically the first and second bodies are provided next to each other (rather than, for example, one of the bodies being provided inside the other). Typically the second body is provided downstream of the first body (e.g. with respect to the acoustic wave source). Typically the first and second acoustic attenuators are provided outside each other. Typically the first and second attenuators are provided opposite each other.

Typically the method comprises providing a gap between the first and second open apertures (and typically between the first and second first and second bodies), the gaps being sized such that resonance of fluid in the first cavity can stimulate resonance of fluid within the cavity of the said second attenuators (at least when the resonance occurs at a frequency within the said resonant frequency bands of the said cavities).

A ninth aspect of the invention provides a method of attenuating acoustic waves emitted by an acoustic wave source, the method comprising: acoustic waves emitted by the acoustic wave source stimulating resonance of a fluid provided within a first cavity defined by a first body comprising an open aperture in fluid communication with the first cavity; and acoustic waves emitted by the acoustic wave source stimulating resonance of a fluid provided within a second cavity defined by a second body comprising an open aperture in fluid communication with the second cavity, wherein the open apertures of the first and second bodies face each other such that resonance of the fluid provided within the first cavity caused by the said acoustic waves stimulates resonance of the fluid provided within the second cavity.

Typically the first body is oriented differently from the second body.

Typically the first and second bodies are provided next to each other (rather than, for example, one of the bodies being provided inside the other). Typically the second body is provided downstream of the first body (e.g. with respect to the acoustic wave source). Typically the first and second acoustic attenuators are provided outside each other. Typically the first and second attenuators are provided opposite each other.

Typically the method comprises providing a gap between the first and second open apertures (and typically between the first and second first and second bodies), the gaps being sized such that resonance of fluid in the first cavity can stimulate resonance of fluid within the cavity of the said second attenuators (at least when the resonance occurs at a frequency within the said resonant frequency bands of the said cavities).

The method may further comprise acoustic waves emitted by the acoustic wave source stimulating resonance of a fluid provided within a third cavity defined by a third body comprising an open aperture in fluid communication with the third cavity, wherein each of the first and third bodies comprise a first face and a second face, the first face comprising the said open aperture of that body, the method further comprising arranging the first and third bodies such that their second faces are adjacent to each other and that fluid can fluid into or out of the cavities defined by the first and third bodies through their respective open apertures.

The method may further comprise acoustic waves emitted by the acoustic wave source stimulating resonance of a fluid provided within a fourth cavity defined by a fourth body of one of the said acoustic attenuators comprising an open aperture in fluid communication with the fourth cavity, wherein the open apertures of the third and fourth bodies face each other, wherein a gap is provided between the open apertures of the third and fourth bodies (and typically between the third and fourth bodies), the gap being sized such that resonance of fluid within the third body caused by the said acoustic waves stimulates resonance of fluid within the fourth body.

It may be that the said open aperture of the first body of the said attenuator is the first of first and second open apertures of the first body which are in fluid communication with the cavity of the first body, the said first and second open apertures of the first body being offset from each other around the longitudinal axis of the said first body (e.g. offset around the perimeter of the first body in a direction having a component perpendicular to the longitudinal axis of the said first body). It may be that the method further comprises incident acoustic waves stimulating resonance of fluid within the cavity of the first body through the first and second apertures.

The method may further comprise providing the first and second open apertures of the said first body directly opposite each other (typically such there is at least some overlap (preferably a complete overlap) between the first and second open apertures in a direction parallel to the line of shortest distance between the first and second faces comprising the first and second apertures).

The method may further comprise acoustic waves emitted by the acoustic wave source stimulating resonance of a fluid provided within a third cavity defined by a third body comprising an open aperture in fluid communication with the third cavity, wherein the said open aperture of the third body is in fluid communication with, and faces, the second open aperture of the first body, wherein the first and third resonant frequency bands at least partially overlap, and a gap is provided between the second open aperture of the first body and the said open aperture of the third body, the gap being sized such that resonance of fluid within the first body caused by the said acoustic waves stimulates resonance of fluid within the third body.

A tenth aspect of the invention provides apparatus comprising a first acoustic attenuator having a (typically elongate) (first) body defining a cavity and first and second open apertures in fluid communication with the cavity, the cavity and the first and second open apertures at least partly defining a resonant frequency band across which the (first) body attenuates incident acoustic waves, wherein the first and second apertures are offset from each other around a longitudinal axis of the said (first) body (e.g. offset around a perimeter of the (first) body in a direction having a component perpendicular to a longitudinal axis of the (first) body).

By providing first and second open apertures in fluid communication with the cavity defined by the said (first) body, the said first and second open apertures being offset from each other around the longitudinal axis of the said (first) body, two masses of fluid will resonate within the cavity (as a result of fluid being able to flow into and out of the cavity through the first and second apertures) when acoustic waves having a frequency within the resonant frequency band of the said body are incident on the attenuator, thereby significantly increasing the acoustic attenuation provided by the attenuator as compared to an attenuator having a cavity of the same volume with only one of the first and second apertures. In addition, the first open aperture can resonantly couple the said cavity of the said body to the cavity of a first adjacent ("nearest neighbour") attenuator and the second open aperture can resonantly couple the said cavity of the said body to the cavity of a second adjacent ("nearest neighbour") attenuator (e.g. different from the first adjacent attenuator). This helps to improve the resonance coupling effect between attenuators per unit volume (the said cavity of the said body being resonantly coupled to the cavities of two adjacent attenuators), which increases the level of attenuation provided. This also helps to broaden the frequency range of attenuation provided.

It may be that the body has a first face comprising the first open aperture and a second face (different from the first face) comprising the second open aperture. It may be that the first and second faces are substantially parallel to each other. It may be that the first and second faces are opposite each other. It may be that the first and second open apertures are directly opposite each other (typically such there is at least some overlap (preferably a complete overlap) between the first and second open apertures in a direction parallel to the line of shortest distance between the first and second faces).

It may be that the apparatus comprises a second acoustic attenuator having a (typically elongate) (first) body defining a cavity and one or more open apertures in fluid communication with the cavity, the cavity and the open apertures at least partly defining a resonant frequency band across which the (first) body attenuates incident acoustic waves. Preferably the second acoustic attenuator comprises first and second apertures offset from each other around a longitudinal axis of the (first) body (e.g. offset around a perimeter of the (first) body in a direction having a component perpendicular to a longitudinal axis of the (first) body).

It may be that the resonant frequency bands of the bodies of the first and second attenuators do not overlap. Typically the resonant frequency bands of the bodies of the first and second attenuators at least partially overlap. It may be that the bodies of the first and second attenuators have the same shapes. It may be that the bodies of the first and second attenuators are identical to each other (albeit they may be oriented differently from each other, for example at 180° to each other). It may be that the bodies of the first and second attenuators have the same shapes but different sizes. It may be that the bodies of the first and second attenuators have different shapes.

Preferably an (e.g. the first) open aperture of the second acoustic attenuator face(s) and is typically in fluid communication with the first open aperture of the said first acoustic attenuator and a gap is provided between the first open aperture of the said first acoustic attenuator and the open aperture of the said second acoustic attenuator. Typically the gap is sized such that resonance of fluid within the cavity of the first acoustic attenuator can stimulate resonance of fluid within the cavity of the second acoustic attenuator (and typically vice versa), at least when the resonance occurs at a frequency within the said resonant frequency bands of both the first and second attenuators.

It may be that the apparatus comprises a third acoustic attenuator having an elongate (first) body defining a cavity and one or more open apertures in fluid communication with the cavity, the cavity and the open apertures at least partly defining a resonant frequency band across which the (first) body attenuates incident acoustic waves. Preferably the third acoustic attenuator comprises first and second apertures offset from each other around a longitudinal axis of the (first) body (e.g. offset around a perimeter of the (first) body in a direction having a component perpendicular to a longitudinal axis of the (first) body).

It may be that the resonant frequency bands of the bodies of the first and third attenuators do not overlap. Typically the resonant frequency bands of the bodies of the first and third attenuators at least partially overlap. It may be that the bodies of the first and third attenuators have the same shapes. It may be that the bodies of the first and third attenuators are identical to each other (albeit they may be oriented differently from each other, for example at 180° to each other). It may be that the bodies of the first and third attenuators have the same shapes but different sizes. It may be that the bodies of the first and second attenuators have different shapes.

Preferably an (e.g. the first) open aperture of the third acoustic attenuator face(s) and is in fluid communication with the second open aperture of the said first acoustic attenuator and a gap is provided between the second open aperture of the said first acoustic attenuator and the open aperture of the said third acoustic attenuator. Typically the gap is sized such that resonance of fluid within the cavity of the first acoustic attenuator can stimulate resonance of fluid within the cavity of the third acoustic attenuator (and typically vice versa), at least when the resonance occurs at a frequency within the said resonant frequency bands of both the first and third attenuators.

It will be understood that the open apertures of one, two or each of the first, second and third attenuators may be elongate open apertures. Where provided, the elongate open apertures may extend along at least a portion of (e.g. at least 30% of, at least 40% of, at least 50% of, at least 90% of) the, or along the entire, length of the (first) body (typically parallel to the longitudinal axis) comprising that elongate open aperture. It may be that the open apertures of one, two or each of the first, second and third attenuators are open apertures of respective groups of discrete open apertures (each group comprising two or more open apertures) provided on the (first) body of each said attenuator and arranged such that a line extending in a direction parallel to a longitudinal axis of the said (first) body extends across each of the apertures within the group. Typically the apertures within each group of apertures are aligned with each other along the length of the said (first) body. The said plurality of discrete open apertures within each group (where provided) may comprise a combined aperture length extending along, for example, at least 30% of, at least 40% of, at least 50% of or at least 90% of the length of the (first) body (parallel to the longitudinal axis of the (first) body). Typically the said plurality of discrete open apertures within each group (where provided) together form an elongate aperture area.

The apparatus may further comprise an acoustic wave source which emits acoustic waves, the acoustic attenuator (s) being provided in an acoustic wave propagation path of the acoustic waves emitted by the acoustic wave source. Typically the resonant frequency band(s) of the attenuator(s) comprise one or more frequencies at which the acoustic wave source emits acoustic waves along the acoustic wave propagation path.

Typically the acoustic attenuator(s) are provided within a radius of 100 metres of the acoustic wave source, more preferably within a radius of 50 metres of the acoustic wave source, even more preferably within a radius of 10 metres of the acoustic wave source, and most preferably within a radius of 1 metre of the acoustic wave source. Typically the attenuation of acoustic waves is more effective the closer the acoustic attenuators are to the acoustic wave source.

Typically the first, second and third attenuators are arranged together (e.g. periodically) in a row. It will be understood that the said row could comprise further such attenuators.

It may be that the apparatus comprises first and second rows of first, second and third (and typically further said) attenuators. It may be that the second row is provided downstream of the first row with respect to acoustic waves emitted by the acoustic wave source. It may be that the attenuators within each row are arranged periodically. It may be that the first and second rows are first and second rows of a plurality of rows, the said rows being arranged (e.g. periodically) so as to attenuate acoustic waves (e.g. emitted by the acoustic wave source) over a further (e.g. resonant) frequency band.

It may be that one or more or each of the said attenuators in the second row is provided opposite (and may abut and may be mechanically coupled to and may face and may be downstream of, with respect to acoustic waves emitted by the acoustic wave source) a respective attenuator of the first row. It may be that the attenuators of the first row are provided with the same or (more typically) different resonant frequency bands from those of the respective attenuators of the second row which they are provided opposite.

It may be that the first and second open apertures of said attenuator of the first row face away from (e.g. at 90° to) the attenuator of the second row provided opposite the said attenuator of the first row. It may be that the first and second open apertures of each said attenuator of the second row face away from (e.g. at 90° to) the attenuator of the first row provided opposite the said attenuator of the second row.

It may be that the first and second rows are separated by a gap.

It may be that the first faces of the bodies of the attenuators of the first row are not flush with the first faces of the bodies of the attenuators of the second row they are provided opposite. For example, the first faces of the bodies of the attenuators of the second row may be set back from the first faces of the bodies of the first row which they are provided opposite. Alternatively it may be that the first faces of the bodies of the attenuators of the first row are flush with the first faces of the bodies of the attenuators of the second row they are provided opposite.

It may be that a plurality of said acoustic attenuators are arranged together (e.g. periodically) to form an acoustic barrier or enclosure in the said acoustic propagation path.

An eleventh aspect of the invention provides apparatus comprising an acoustic attenuator having first and second (typically elongate) bodies each defining a cavity and having at least one open aperture in fluid communication with the cavity, the cavity and the open aperture at least partly defining a resonant frequency band across which the body attenuates incident acoustic waves, wherein the first and second bodies each comprise a first face and a second face, the apertures being provided in the first face, and the first and second bodies being arranged such that their second faces are adjacent to each other and that fluid can flow into and out of the cavities of the first and second bodies through the open apertures of the first and second bodies (typically without obstruction from the other of the first and second bodies).

By the second faces of first and second bodies being adjacent to each other we mean that the second face of the first body is provided closer to second face of the second body than to the first face of the second body (and vice versa).

Typically the first and second faces of each of the said attenuators are separated by a gap.

Typically the first and second faces of the said bodies of the first and second attenuators are planar faces. Typically the first and second faces of the said bodies of the first and second attenuators are substantially parallel to each other. Typically the second faces of the first and second attenuators abut each other. Typically the second faces of the first and second attenuators are mechanically coupled to each other.

Typically the first and second attenuators are provided next to each other (rather than, for example, one of the attenuators being provided inside the other). Typically the first and second attenuators are provided outside each other. Typically the first and second attenuators are provided opposite each other. It may be that the (first) bodies of the first and second attenuators are identical to each other, but oriented at 180° to each other.

It will be understood that the open apertures of one or both of the first and second attenuators may be elongate open apertures. Where provided, the elongate open apertures may extend along at least a portion of (e.g. at least 30% of, at least 40% of, at least 50% of, at least 90% of) the, or along the entire, length of the (first) body (typically parallel to the longitudinal axis) comprising that elongate open aperture. It may be that the open apertures of one or both of the first and second attenuators are open apertures of respective groups of discrete open apertures (each group comprising two or more open apertures) provided on the (first) body of each said attenuator and arranged such that a line extending in a direction parallel to a longitudinal axis of the said (first) body extends across each of the apertures within the group. Typically the apertures within each group of apertures are aligned with each other along the length of the said (first) body. The said plurality of discrete open apertures within each group (where provided) may comprise a combined aperture length extending along, for example, at least 30% of, at least 40% of, at least 50% of or at least 90% of the length of the (first) body (parallel to the longitudinal axis of the (first) body). Typically the said plurality of discrete open apertures within each group (where provided) together form an elongate aperture area.

It may be that the first and second bodies have at least partially overlapping resonant frequency bands. It may be that the first and second bodies have different resonant frequency bands. It may be that the first and second bodies have resonant frequency bands which do not overlap. It may be that the first and second bodies have the same shapes. It may be that the first and second bodies are identical to each other (albeit they may be oriented differently from each other, for example at 180° to each other). It may be that the first and second bodies have the same shapes but different sizes. It may be that the first and second bodies have different shapes. It may be that the second face of the first body (typically completely) overlaps the second face of the second body, and it may be that the second face of the first body extends beyond the second face of the second body.

It may be that the first and second bodies are first and second bodies of a first pair of first and second bodies. It may be that one or more further pairs of said first and second bodies are arranged (e.g. periodically) together with the said first pair of first and second bodies in a row. It may be that the first body of the first pair is provided adjacent to the second body of a second pair within the said row. It may be that the first body of the first pair is provided adjacent to the first body of a second pair within the said row.

It may be that the apparatus comprises an acoustic wave source which emits acoustic waves having one or more frequencies within the resonant frequency bands of the first and/or second bodies. It may be that the acoustic attenuator is provided in an acoustic wave propagation path of the acoustic waves emitted by the acoustic wave source. It may be that the row extends perpendicularly to an acoustic wave propagation path of acoustic waves emitted by the acoustic wave source.

It may be that the first and second bodies of the first pair each have a first resonant frequency band (and typically the same shape and typically the same size as each other). It may be that the first and second bodies of the second pair each have a second resonant frequency band different from the first resonant frequency bands (and typically the same shape and typically the same size as each other). It may be that the first and second bodies of the second pair have different sizes and/or shapes from the first and second bodies of the first pair.

It may be that the attenuator comprises first and second rows of said pairs of first and second bodies. It may be that the second row is provided downstream of the first row with respect to acoustic waves emitted by the acoustic wave source.

It may be that the pairs of first and second bodies within each of the first and second rows are arranged periodically. It may be that the first and second rows are first and second rows of a plurality of rows of said pairs of first and second bodies, the said rows being arranged (e.g. periodically) so as to attenuate acoustic waves (e.g. emitted by the acoustic wave source) over a further (e.g. resonant) frequency band.

It may be that a said body of each pair in the second row is provided opposite (and may abut and may be mechanically coupled to and may face and may be downstream of, with respect to acoustic waves emitted by the acoustic wave source) a body of a said pair of the first row.

It may be that the bodies of the first row are provided with the same or (more typically) different resonant frequency bands from those of the respective bodies of the second row which they are provided opposite.

It may be that the open apertures of each said pair of the first row face away from (e.g. at 90° to) the pair of the second row provided opposite the said pair of the first row. It may be that the open apertures of each said pair of the second row face away from (e.g. at 90° to) the pair of the first row provided opposite the said pair of the second row.

It may be that the first and second rows are separated by a gap.

It may be that the first faces of the bodies of the first row are not flush with the first faces of the bodies of the second row they are provided opposite. For example, the first faces of the bodies of the second row may be set back from the first faces of the bodies of the first row which they are provided opposite. Alternatively it may be that the first faces of the bodies of the first row are flush with the first faces of the bodies of the second row they are provided opposite. It may be that the second faces of the bodies of one or more or each said pair of bodies of the first row abut each other, while the second faces of one or more or each said pair of bodies of the second row are separated by a gap. For example, it may be that the first and second faces of the bodies of one or both bodies of each said pair of the second row are separated by a smaller gap than the first and second faces of one or both of the bodies of the said pair of the first row which they are provided opposite, and the second faces of one or more or each said pair of bodies of the second row are separated by a gap so that the first faces of the said bodies of the said pair of the second row are flush with the first faces of the said bodies of the said pair of the first row which they are provided opposite. By providing the first faces of the bodies of the first row flush with the first faces of the second row, the first and second rows are more easily incorporated into an acoustic barrier or enclosure and a stronger resonance coupling that can be achieved between adjacent ("nearest neighbour") bodies within a row.

It may be that the apparatus further comprises a third body defining a cavity and having at least one open aperture in fluid communication with the cavity, the cavity and the open aperture at least partly defining a resonant frequency band across which the third body attenuates incident acoustic waves. It may be that the said open aperture of the third body is provided in fluid communication with, and facing, the said open aperture of the first body, the first and third bodies at least partly defining at least partially overlapping resonant frequency bands and a gap being provided between the open apertures of the said first and third bodies (and typically between the first and third bodies), the gap being sized such that resonance of fluid within the cavity of the said first body can stimulate resonance of fluid within the cavity of the third body.

It may be that the third body is a first or second body of the said second pair of said first and second bodies.

It may be that the apparatus further comprises a fourth body defining a cavity and having at least one open aperture in fluid communication with the cavity, the cavity and the open aperture at least partly defining a resonant frequency band across which the fourth body attenuates incident acoustic waves. It may be that the said open aperture of the fourth body is provided in fluid communication with, and facing, the said open aperture of the second body, the second and fourth bodies at least partly defining at least partially overlapping resonant frequency bands and a gap being provided between the open apertures of the said second and fourth bodies (and typically between the second and fourth bodies), the gap being sized such that resonance of fluid within the cavity of the said second body can stimulate resonance of fluid within the cavity of the fourth body.

It may be that the fourth body is a first or second body of a third pair of said first and second bodies, the third pair being adjacent to the first pair of first and second bodies within the said row.

It may be that the second and third pairs are identical to the first pair.

Typically the acoustic attenuator is provided within a radius of 100 metres of the acoustic wave source, more preferably within a radius of 50 metres of the acoustic wave source, even more preferably within a radius of 10 metres of the acoustic wave source, and most preferably within a radius of 1 metre of the acoustic wave source. Typically the attenuation of acoustic waves is more effective the closer the acoustic attenuators are to the acoustic wave source.

It may be that a plurality of said acoustic attenuators are arranged together (e.g. periodically) to form an acoustic barrier or enclosure in the said acoustic propagation path.

The acoustic attenuators may have any of the essential or preferred features of the acoustic attenuators described in US2014/0166391 which is incorporated here by reference.

The acoustic attenuators may be together arranged in any of the arrangements described in US2014/0166391 which is incorporated here by reference.

The preferred and optional features discussed above are preferred and optional features of each aspect of the invention to which they are applicable.

DESCRIPTION OF THE DRAWINGS

An example embodiment of the present invention will now be illustrated with reference to the following Figures in which.

DETAILED DESCRIPTION OF AN EXAMPLE EMBODIMENT

Figure 1:
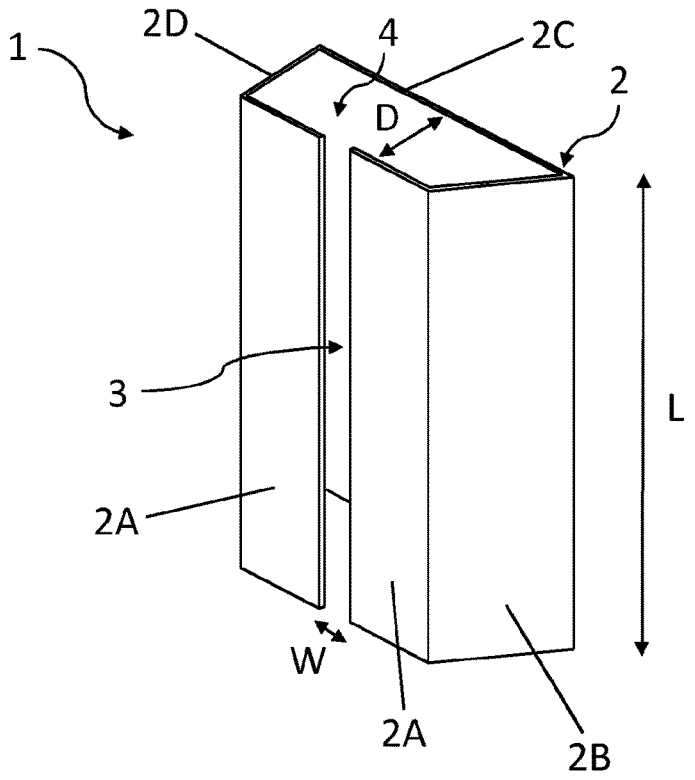
FIG. 1 is a perspective view of an acoustic attenuator.
Figure 2:
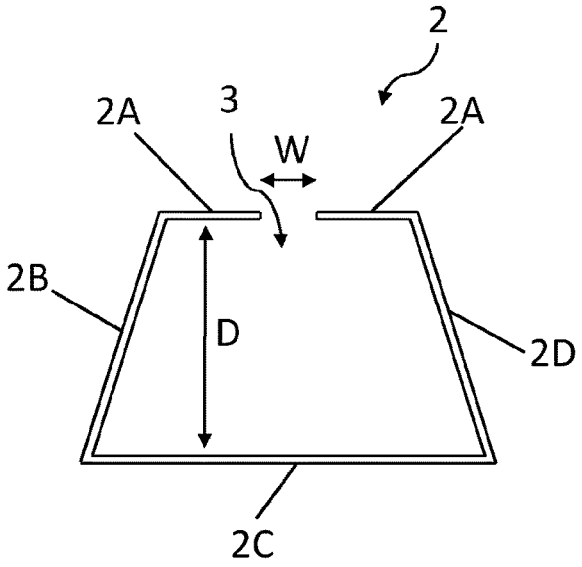
FIG. 2 is a cross section through the acoustic attenuator of FIG. 1.

With reference to FIG. 1, a monolithic acoustic attenuator 1 comprises a hollow, elongate body 2 of length L. The body 2 comprises four walls 2A, 2B, 2C and 2D. Walls 2A and 2C are arranged parallel to each other. The parallel walls 2A and 2C are separated by a gap, the shortest distance between the parallel walls 2A, 2C being indicated as D in FIG. 1. Walls 2B and 2D extend between walls 2A and 2C, converging towards each other from wall 2C to wall 2A which has a shorter width than wall 2C. The four walls 2A, 2B, 2C and 2D are, therefore, arranged to form a trapezoidal cross section (i.e. in cross section perpendicular to a longitudinal axis of the body 2 parallel to its length L) as illustrated in FIG. 2. An aperture 3 of width W is provided at an intermediate portion of wall 2A in fluid communication with an internal cavity 4 defined by the body 2.

The body 2 is a solid (e.g. steel or plastic) body and is typically provided in a fluidic host medium which, for the purposes of the discussion below will be assumed to be air. However, it will be understood that the fluidic host medium may comprise any other suitable gas or liquid or a mixture of a gas and a liquid.

The aperture 3 has a length equal to the length L of the body 2. In alternative embodiments, the length of the aperture may be less than the length L of the body 2 (for example, the length of the aperture may be at least 50%, at least 75% or at least 90% of the length L). In other embodiments, a plurality of discrete apertures may be provided along the length L of the body 2 (in which case the combined aperture length parallel to the longitudinal axis of the body 2 of the plurality of discrete apertures is typically at least 50%, at least 75% or at least 90% of the length L).

The acoustic attenuator 1 attenuates incident acoustic waves by at least two physical mechanisms. The first mechanism is the transfer of energy from incident acoustic waves (having frequencies within a resonant frequency band of the attenuator 1) to air (or other fluid) within the cavity by stimulation of resonance of air (or other fluid) within the cavity 4 by incident acoustic waves. More specifically, when an acoustic wave of frequency f is incident on the aperture 3, it causes displacement of air from the aperture 3 into the cavity 4. This causes the (air) pressure inside the cavity 4 to rise. The increased air pressure inside the cavity 4 exerts a force on the air in the aperture 3, subsequently causing air to be pushed back out of the cavity 4 through the aperture 3 and into the surroundings. Since the air in the aperture 3 has momentum, it continues to travel beyond its initial position inside the aperture 3. This causes the pressure in the cavity 4 to drop, leading to air being subsequently drawn back into the cavity 4 through the aperture 3. These air pressure oscillations usually decay with time. However, when the frequency f of the incident acoustic wave lies within the resonant frequency band of the cavity 4, the acoustic wave continues to stimulate resonance of the air in the cavity 4. A significant proportion of the energy carried by the acoustic wave is transferred to the air in this process, leading to attenuation of the acoustic wave. The particular resonant frequency band of the air in the cavity 4 is dependent on the geometry of the acoustic attenuator 1 and, in particular, the volume of the cavity 4 (and thus the length L of the body 2 and the distance D). The resonant frequency band also depends on the width of the aperture W and the thickness of the attenuator body 2. Although not shown, it may be that the body 2 further comprises a neck extending from the edge(s) of the open aperture 3 into and/or away from the cavity 4. In this case, the said resonant frequency band is also dependent on the length of the neck. The geometry of the acoustic attenuator 1 may, therefore, be tuned to attenuate acoustic waves over a first frequency band.

The second mechanism of acoustic attenuation is a one dimensional sonic crystal effect provided by the parallel walls 2A, 2C and the gap provided between them. The propagation of mechanical (acoustic) waves in a medium is usually described by a dispersion relation that relates the (angular) frequency F, and wave vector, k, of the propagating acoustic wave. The dispersion relation for waves travelling in a homogeneous medium is:

$$2\pi F = ck,$$

where c is the velocity of sound in the host medium (typically air).

Another relation which is useful to define is the Bragg condition:

$$n\lambda = 2D\sin(\alpha),$$

where n is an integer or a half-integer, λ is the wavelength of the acoustic waves incident on the walls 2A, 2C and D is the shortest distance between parallel walls 2A and 2C, and where the frequency F and the wavelength λ are related to the velocity of the first and second waves c by:

$$c = F\lambda$$

The walls 2A, 2C provide density variations ("interfaces") to acoustic waves propagating in the (air) host medium. When incident acoustic waves encounter the interfaces, they transfer part of their energy into secondary, multiply scattered waves which then interfere with each other. As the walls 2A, 2C are parallel, the acoustic waves are strongly dispersed from one wall 2A to the other 2C, and end up filling all available space between the walls 2A, 2C and propagating in every possible direction. When the Bragg condition is satisfied, interference occurs between the scattered waves, leading to the formation of acoustic "band gaps" that prevent acoustic waves with certain frequencies travelling through the body 2. This is due to the modification of the dispersion relation. The scattered waves interfere constructively or destructively depending on the wave frequency and the sonic crystal geometry. A band gap appears when the scattered waves interfere destructively in a given direction, causing the superposition of waves at that frequency to decrease exponentially when traversing the body 2. These properties are strictly true for the frequencies that fall within the complete band gap. For other frequencies, destructive interferences are balanced by constructive ones and waves are transmitted at least partially. A band gap will occur at multiples of the fundamental affected frequency.

Thus, when acoustic waves of frequency F propagating in a direction having a component parallel to the distance D between the walls 2A, 2C are incident on the walls 2A, 2C at an angle of incidence α, the frequency F and the angle of incidence α satisfying a Bragg condition defined by the shortest distance D between the walls 2A, 2C, the incident acoustic waves are multiply scattered by walls 2A, 2C. The scattered waves (at least partly, or completely) destructively interfere with each other, significantly reducing the transmission of waves having frequency F through the acoustic attenuator 1.

Although the first and second walls 2A, 2C are required to be parallel to each other for the Bragg condition to be satisfied (and it is preferable for the first and second walls to be parallel), significant attenuation effects are still achieved even when the first and second walls are not quite parallel to each other. Indeed, acoustic wave attenuation effects have been observed by this effect when the normal to the first wall 2A and the normal to the second wall 2C intersect at angles of up to 20°.

It will be understood that as a consequence of the Bragg condition, acoustic waves having a wavelength λ equal to the distance D (or acoustic waves having a wavelength which is a factor of D) are most strongly attenuated. As the one dimensional sonic crystal effect is finite (there being only two scattering surfaces 2A, 2C in this embodiment), it will be understood that acoustic waves across acoustic frequency bands centred on frequencies meeting the Bragg condition (as opposed to only acoustic waves having frequencies which precisely meet the Bragg condition) are attenuated. However, the inventors have discovered that this effect can be used to usefully (multiply) scatter (and thereby attenuate, from the point of view of an observer on an opposite side of the attenuator from an acoustic wave source emitting) acoustic waves having frequencies and angles of incidence on the walls 2A, 2C satisfying the Bragg condition.

The acoustic attenuator 1 therefore individually achieves both local resonance-based attenuation of incident acoustic waves having frequencies f and Bragg scattering of incident acoustic waves having frequencies F and angles of incidence α satisfying the Bragg condition. In some cases the frequencies f and F are the same (such that the two mechanisms combine to attenuate acoustic waves having frequencies f and F more strongly), but more typically the frequencies attenuated by the two mechanisms are different. Nevertheless, there may be at least partial overlap between the two frequency bands.

The one dimensional sonic crystal mechanism is largely independent of the cross-sectional shape of the attenuator body 2, provided that the shape comprises two parallel walls separated by a distance D. For example, in an alternative embodiment illustrated in FIG. 3, an attenuator body 5 has four walls 5A, 5B, 5C and 5D arranged in a substantially square cross section (again the cross section is taken perpendicular to the longitudinal axis of the body 5). The walls 5A and 5C are separated by a distance D and are parallel to each other, as are the walls 5B and 5D. An aperture of width W is provided in the wall 5A. The mechanisms of attenuation are the same as in the embodiment illustrated in FIGS. 1 and 2, with the one dimensional sonic crystal effect arising due to multiple scattering of incident acoustic waves by the walls 5A and 5C meeting the Bragg condition defined by the gap between them (and consequent (typically destructive) interference and attenuation of the said incident acoustic waves). It will be understood that a further one dimensional sonic crystal effect (in a perpendicular propagation plane to that provided by walls 5A, 5C) is provided due to the multiple scattering of incident acoustic waves by the walls 5B and 5D meeting the Bragg condition defined by the gap between them (and consequent (typically destructive) interference and attenuation of the said incident waves).

Figure 4:
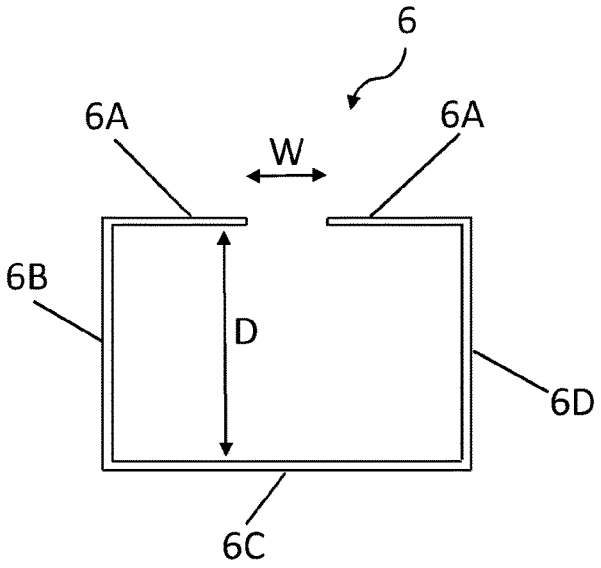
FIG. 4 is a cross section through a further alternative acoustic attenuator.

In an another alternative embodiment illustrated in FIG. 4, an attenuator body 6 comprises four walls 6A, 6B, 6C and 6D arranged in a substantially rectangular cross section (again the cross section is taken perpendicular to the longitudinal axis of the body 6). The walls 6A and 6C are separated by a distance D and are parallel to each other. The walls 6B and 6D are also parallel to each other. An aperture of width W is provided in the wall 6A. The mechanisms of attenuation are the same as in the embodiment illustrated in FIGS. 1 and 2, with the one dimensional sonic crystal effect arising due to multiple scattering of incident acoustic waves by the walls 6A and 6C meeting the Bragg condition defined by the gap between them (and consequent (typically destructive) interference and attenuation of the said incident acoustic waves). It will be understood that a further one dimensional sonic crystal effect (in a perpendicular propagation plane to that provided by walls 6A, 6C) is provided due to the multiple scattering of incident acoustic waves by the walls 6B and 6D meeting the Bragg condition defined by the gap between them (and consequent (typically destructive) interference and attenuation of the said incident acoustic waves).

Figure 5:
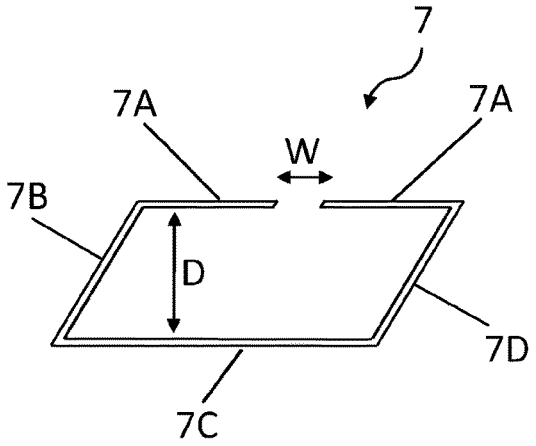
FIG. 5 is a cross section through a yet further alternative acoustic attenuator.

In an another alternative embodiment illustrated in FIG. 5, an attenuator body 7 comprises four walls 7A, 7B, 7C and 7D arranged in a substantially parallelogrammatical cross section (again the cross section is taken perpendicular to the longitudinal axis of the body 7). The walls 7A and 7C are separated by a distance D and are parallel to each other. The walls 7B and 7D are also parallel to each other. An aperture of width W is provided in the wall 7A. The mechanisms of attenuation are the same as in the embodiment illustrated in FIGS. 1 and 2, with the one dimensional sonic crystal effect arising due to multiple scattering of incident acoustic waves by the walls 7A and 7C meeting the Bragg condition defined by the gap between them (and consequent (typically destructive) interference and attenuation of the said incident acoustic waves). It will be understood that a further one dimensional sonic crystal effect (in a different propagation plane to that provided by walls 7A, 7C) is provided due to the multiple scattering of incident acoustic waves by the walls 7B and 7D meeting the Bragg condition defined by the gap between them (and consequent (typically destructive) interference and attenuation of the said incident acoustic waves).

Figure 6:
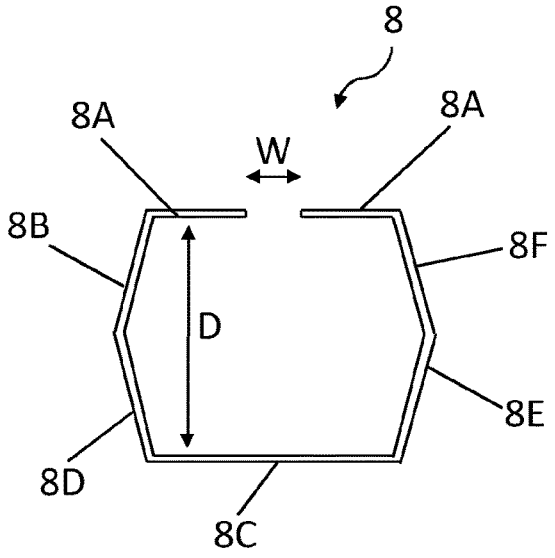
FIG. 6 is a cross section through a yet further alternative acoustic attenuator.

In an another alternative embodiment illustrated in FIG. 6, an attenuator body 8 has six walls 8A, 8B, 8C, 8D, 8E and 8F arranged in a substantially hexagonal cross section (again the cross section is taken perpendicular to the longitudinal axis of the body 8). The walls 8A and 8C are separated by a distance D and are parallel to each other. An aperture of width W is provided in the wall 8A. The mechanisms of attenuation are the same as in the embodiment illustrated in FIGS. 1 and 2, with the one dimensional sonic crystal effect arising due to multiple scattering of incident acoustic waves by the walls 8A and 8C meeting the Bragg condition defined by the gap between them (and consequent (typically destructive) interference and attenuation). It will be understood that a further one dimensional sonic crystal effect (in a different propagation plane to that provided by walls 8A, 8C) is provided due to the multiple scattering of incident acoustic waves by the walls 8B and 8E meeting the Bragg condition defined by the gap between them (and consequent (typically destructive) interference and attenuation of the said incident acoustic waves). A yet further one dimensional sonic crystal effect (in different propagation planes to those provided by walls 8A, 8C and walls 8B, 8E) is provided due to the multiple scattering of incident acoustic waves by the walls 8D and 8F meeting the Bragg condition defined by the gap between them (and consequent (typically destructive) interference and attenuation of the said incident acoustic waves).

In other alternative embodiments, the parallel walls providing the one dimensional sonic crystal effect may be provided as parts of (two) separate bodies. For example, as illustrated in cross section in FIG. 7, an acoustic attenuator 9 comprises a first attenuator body 10 and a second attenuator body 11. Both first and second attenuator bodies 10 and 11 have identical triangular cross sections (again the cross sections are taken perpendicular to the longitudinal axes of the bodies 10, 11). Attenuator body 10 comprises three walls 10A, 10B and 10C, none of which are parallel to each other. Attenuator body 11 comprises three walls 11A, 11B and 11C, none of which are parallel to each other. The first and second attenuator bodies 10 and 11 are identical but oriented 180° from each other such that wall 10A is parallel to wall 11A. The first and second attenuator bodies 10, 11 are also provided next to each other in a row arrangement, sufficiently close to each other that a portion of wall 10A is opposite a portion of wall 11A, the shortest distance between said portions of walls 10A and 11A being indicated at D in FIG. 7. Open apertures of width W are provided in both walls 10A and 11A. Each attenuator body 10 and 11 functions separately to attenuate acoustic waves by the local resonance effect described above (typically with substantially the same resonance frequency bands). In addition, the two attenuator bodies 10 and 11 together function synergistically to attenuate acoustic waves due to the one dimensional sonic crystal effect discussed above. More specifically, acoustic waves having a frequency and angle of incidence on the parallel and opposing portions of walls 10A, 11A satisfying the Bragg condition defined by the distance D between them are multiply scattered by the said parallel and opposing portions of the walls 10A and 11A (the said incident acoustic waves consequently (typically destructively) interfering and thereby being attenuated).

Figure 8:
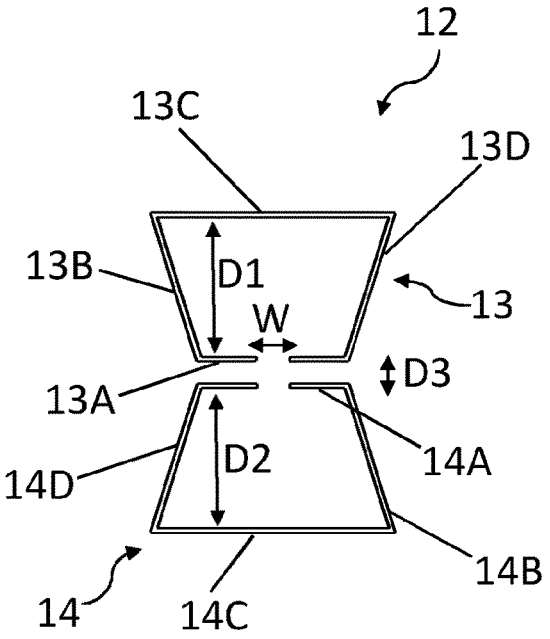
FIG. 8 is a cross section through a yet further alternative acoustic attenuator.

Another alternative acoustic attenuator 12 is illustrated in cross section in FIG. 8, the alternative acoustic attenuator 12 comprising a first attenuator body 13 and a second attenuator body 14, each individually having a trapezoidal cross-section (again the cross-sections are taken perpendicular to longitudinal axes of bodies 13, 14) as described above with respect to the acoustic attenuator 1 illustrated in FIGS. 1 and 2. Indeed, attenuator bodies 13, 14 are identical, but oriented at 180° to each other. Attenuator body 13 comprises four walls 13A, 13B, 13C and 13D, walls 13A and 13C being parallel and separated by a distance D1. Attenuator body 14 comprises four walls 14A, 14B, 14C and 14D, walls 14A and 14C being parallel and separated by a distance D2. Open apertures of width W are provided at intermediate portions of the walls 13A and 14A. The two attenuator bodies 13 and 14 are positioned such that walls 13A and 14A are parallel and adjacent to each other, the apertures in walls 13A and 14A also being in fluid communication with each other with a direct line of sight between them. The two attenuator bodies 13 and 14 (and indeed their open apertures) are separated by a distance D3.

Each attenuator body 13 and 14 functions separately to attenuate acoustic waves due to the local resonance effect described above. The resonance frequency bands of the bodies 13, 14 are typically the same, or at least there is some overlap between them. The local resonance effect in each body, 13 or 14, is strengthened by the presence of the other. Resonance of air (or other fluidic host medium) in the cavity of body 13 stimulates resonance of air (or other fluidic host medium) in the cavity of body 14, and resonance of air (or other fluidic host medium) in the cavity of body 14 stimulates resonance of air (or other fluidic host medium) in the cavity of body 13. This strong resonance coupling between bodies 13, 14 leads to a stronger acoustic wave attenuation at least in the overlapping portions of the resonant frequency bands of the bodies 13, 14. The two bodies 13 and 14 also attenuate acoustic waves due to a number of different one dimensional sonic crystal effects. More specifically, acoustic waves with frequencies and angles of incidence satisfying Bragg conditions defined by the spacings (D1, D2, D1+D3, D2+D3, D1+D2+D3—see below) between any pairs of parallel walls taken from the group 13A, 13C, 14A and 14C are multiply scattered, and thus attenuated by the attenuator 12 by the one dimensional sonic crystal effect described above. Scattered waves from different pairings of parallel walls lead to attenuation of acoustic waves of different frequencies determined by Bragg conditions defined by the spacings between them. For example, walls 13A and 13C are separated by a distance D1 and walls 14A and 14C are separated by a distance D2. Walls 13A and 14A are separated by a distance D3, and walls 13C and 14C are separated by a distance D1+D2+D3. Walls 13A and 14C are separated by a distance D2+D3. Walls 14A and 13C are separated by a distance D1+D3. Each different spacing defines a different Bragg condition. The attenuator 12, therefore, provides several possible frequency bands for acoustic attenuation. It will be understood that typically D1 and D2 are substantially equal, and so the Bragg conditions defined by the spacings between walls 13A, 13C and between walls 14A, 14C are typically the same or similar. In an advantageous embodiment, D1, D2 and D3 are equal. In this case, the Bragg conditions defined by the spacings D1, D2 and D3 are the same. This provides an enhanced sonic crystal attenuation effect for acoustic waves satisfying these Bragg conditions.

Figure 9:
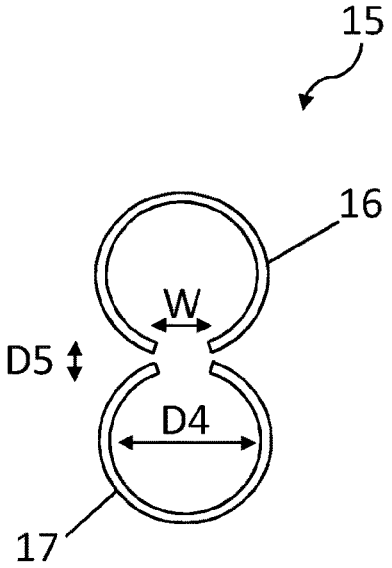
FIG. 9 is a cross section through a yet further alternative acoustic attenuator.

An alternative acoustic attenuator 15 is illustrated in cross section in FIG. 9, comprising a first attenuator body 16 and a second attenuator body 17, each having a substantially circular (i.e. circular but for the presence of apertures—see below) cross-section (again the cross sections are taken perpendicular to the longitudinal axes of bodies 16, 17). The attenuator bodies 16 and 17 have the same substantially circular cross-sectional circumferences defined by diameter D4. Apertures of width W are provided in both walls 16 and 17. The attenuator bodies 16, 17 are identical, but oriented at 180° to each other such that their open apertures face each other and are in fluid communication with a direct line of sight between them. The two attenuator bodies 16 and 17 are positioned adjacent to each other, the shortest distance between the two bodies being indicated at D5 in FIG. 9. The attenuator bodies 16 and 17 function separately to attenuate acoustic waves due to the local resonance effect described above. Moreover, the two attenuator bodies 16 and 17 together function synergistically. More specifically, the acoustic wave attenuation due to local resonance of the air in either body 16 or 17 is strengthened by the presence of the other. Resonance of the air (or other fluidic host medium) in the cavity of body 16 stimulates resonance of the air (or other fluidic host medium) in the cavity of body 17, and resonance of the air (or other fluidic host medium) in the cavity of body 17 stimulates resonance of the air (or other fluidic host medium) in the cavity of body 16. This leads to a stronger coupling between bodies 16, 17, providing stronger acoustic wave attenuation at frequencies within the resonant frequency bands of the bodies 16, 17.

Figure 10:
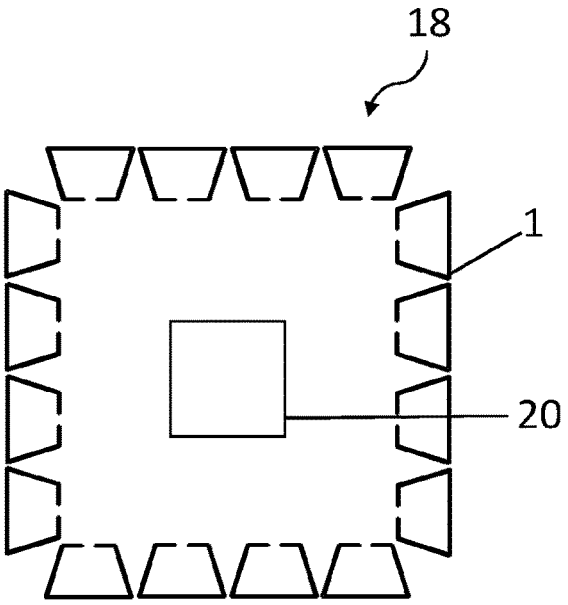
FIG. 10 is a plan view of an enclosure formed by acoustic attenuators as shown in FIG. 2 and a source of acoustic waves.

With reference to FIG. 10, an acoustic barrier 18 comprises a plurality of acoustic attenuators 1 as illustrated in FIGS. 1 and 2. The acoustic attenuators 1 are arranged periodically in each of four rows of acoustic attenuators 1 which together provide a four sided enclosure comprising an acoustic wave source 20. The acoustic attenuators 1 form an acoustic barrier which is one layer thick. The acoustic attenuators 1 are arranged periodically (in this case, the spacing between each pair of adjacent attenuators in each of the four rows of the enclosure is identical). A gap is provided between each pair of adjacent acoustic attenuators 1 in the barrier. The acoustic attenuators 1 are also arranged such that the apertures in the bodies of each of the attenuators 1 have a direct line of sight to the source 20. Typically the bodies of the attenuators 1 are fixedly coupled to each other by way of a fixed attachment to a common frame extending between them. The acoustic barrier 18 attenuates some of the acoustic waves generated by the source 20. In particular, the acoustic barrier 18 attenuates those acoustic waves generated by the source 20 with frequencies which stimulate resonance of the air in the individual cavities of the acoustic attenuators 1 and with frequencies and angles of incidence on the walls 2A, 2C of the attenuators 1 which satisfy the Bragg condition defined by the spacing between them.

Figure 7:
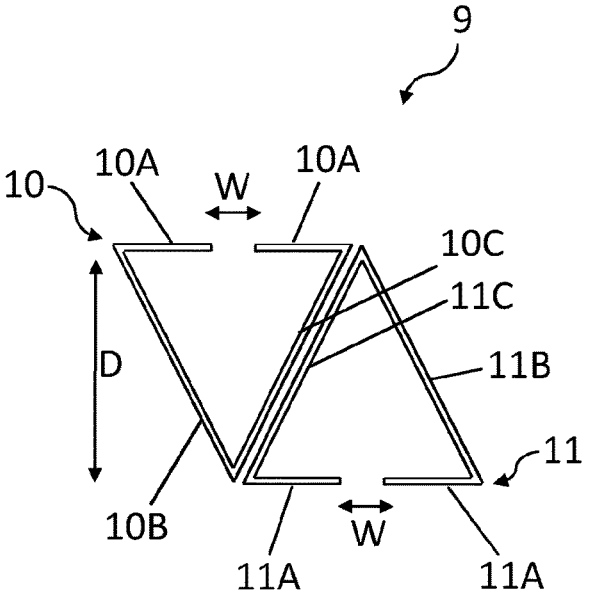
FIG. 7 is a cross section through a yet further alternative acoustic attenuator.
Figure 11:
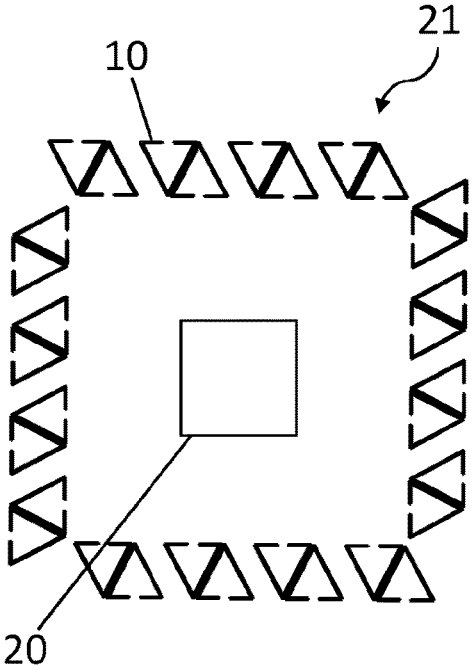
FIG. 11 is a plan view of an enclosure formed by acoustic attenuators as shown in FIG. 7 and a source of acoustic waves.

An alternative acoustic barrier 21 is illustrated in FIG. 11. The acoustic barrier 21 comprises a single layer of acoustic attenuators 10 as illustrated in FIG. 7, the acoustic attenuators 10 again being arranged periodically in each of four rows which together provide a four sided enclosure comprising the acoustic wave source 20. Typically the bodies of the attenuators 10 are fixedly coupled to each other by way of a fixed attachment to a common frame extending between them. Each adjacent pair of acoustic attenuators 10 within each of the four rows of the barrier is separated by a gap. The acoustic barrier 21 attenuates acoustic waves generated by the source 20 which stimulate resonance of the air in the individual cavities of the acoustic attenuators 10 and with frequencies and angles of incidence on walls 10A, 11A which satisfy the respective Bragg condition defined by the spacing between them (see above).

Figure 12:
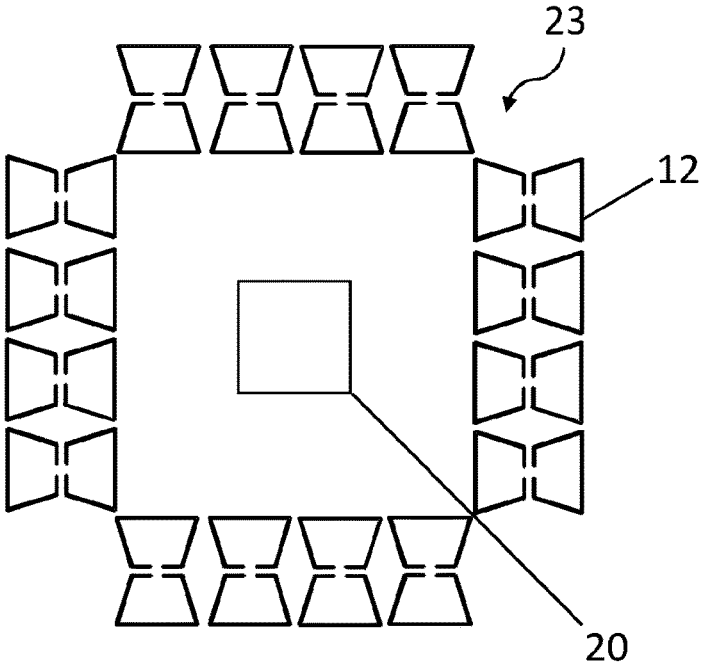
FIG. 12 is a plan view of an enclosure formed by acoustic attenuators as shown in FIG. 8 and a source of acoustic waves.

An alternative acoustic barrier 23 is illustrated in FIG. 12. The acoustic barrier 23 comprises a single layer of acoustic attenuators 12 as illustrated in FIG. 8, the acoustic attenuators 12 again being arranged periodically in each of four rows which together provide a four sided enclosure comprising the acoustic wave source 20. Typically the bodies of the attenuators 12 are fixedly coupled to each other by way of a fixed attachment to one or more frames extending between them. Each adjacent pair of acoustic attenuators 12 within each of the four rows of the barrier is separated by a gap. The acoustic barrier 23 attenuates acoustic waves generated by the source 20 which stimulate resonance of the air in the individual cavities of the acoustic attenuators 12 and with frequencies and angles of incidence on any pairs of walls 13A, 13C, 14A, 14C of the attenuators 12 which satisfy the respective Bragg conditions defined by the spacing between the said pairs of walls (see above).

Figure 13:
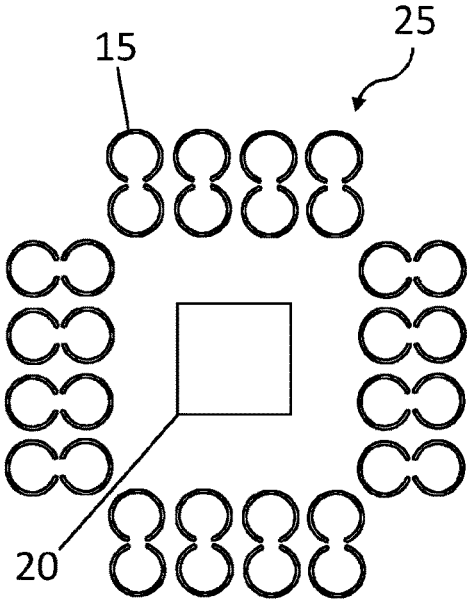
FIG. 13 is a plan view of an enclosure formed by acoustic attenuators as shown in FIG. 9 and a source of acoustic waves.

An alternative acoustic barrier 25 is illustrated in FIG. 13. The acoustic barrier 25 comprises a single layer of acoustic attenuators 15 as illustrated in FIG. 9, the acoustic attenuators 15 again being arranged periodically in each of four rows which together provide a four sided enclosure comprising the acoustic wave source 20. Typically the bodies of the attenuators 15 are fixedly coupled to each other by way of a fixed attachment to one or more frames extending between them. Each adjacent pair of acoustic attenuators 15 within each of the four rows of the barrier is separated by a gap. The acoustic barrier 25 attenuates those acoustic waves generated by the source 20 with frequencies which stimulate resonance of the air in the individual cavities of the acoustic attenuators 15.

Figure 14:
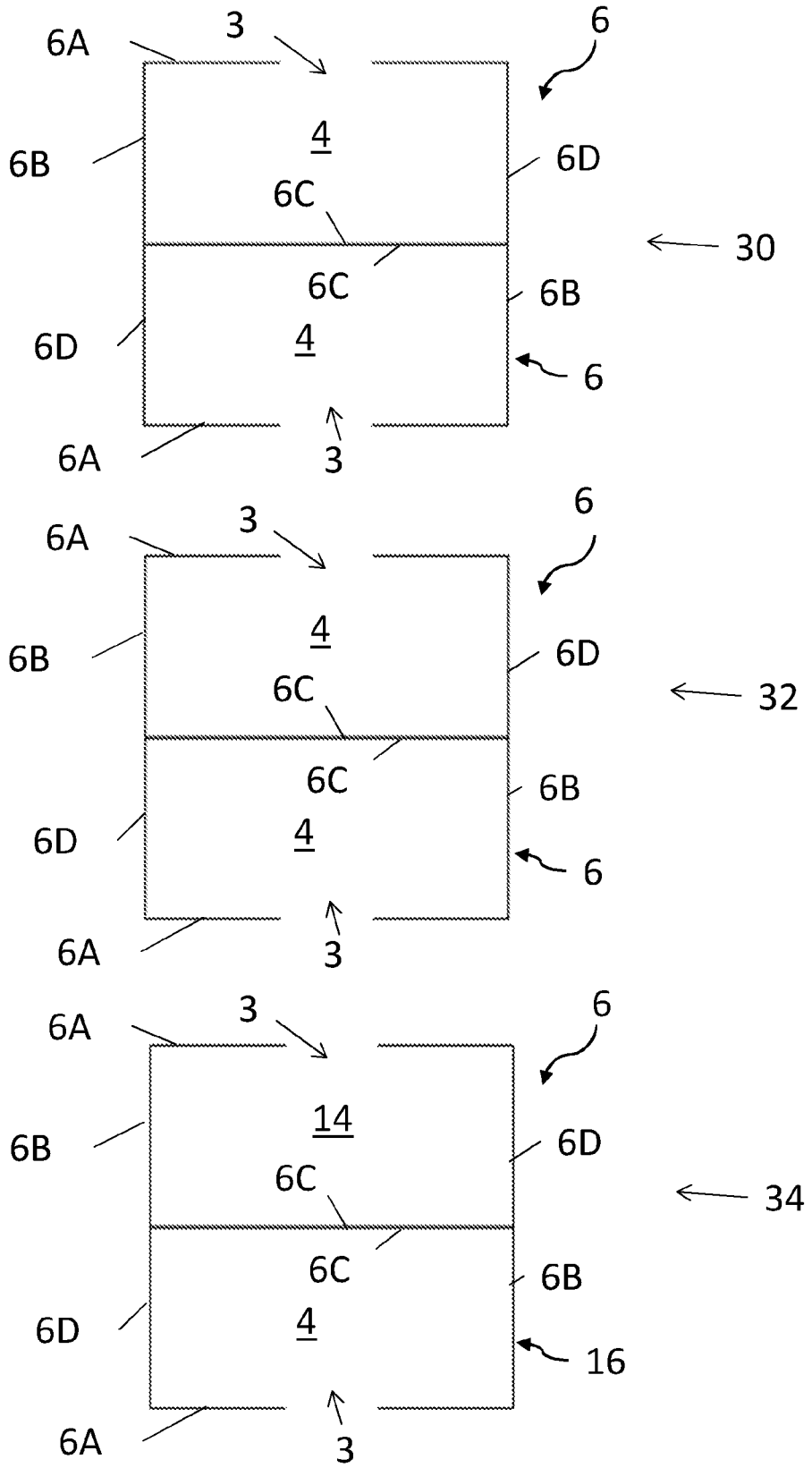
FIG. 14 is a sectional view of six elongate acoustic attenuators taken perpendicular to their longitudinal axes, the acoustic attenuators being arranged in back-to-back pairs with their open apertures facing outwards.

FIG. 14 shows six acoustic attenuator bodies 6 of the type shown in FIG. 4 and described above with reference thereto, the said six acoustic attenuator bodies 6 being arranged into three pairs 30, 32, 34 which are themselves arranged in a row with gaps being provided between adjacent pairs. The attenuator bodies 6 within each pair are oriented at 180° to each other such that their walls 6C are adjacent to each other and abut each other. It may be that the walls 6C of the attenuator bodies 6 within each pair are mechanically coupled to each other (e.g. they may be fastened or bonded to each other). The walls 6A of the attenuator bodies 6, and the elongate open apertures 3 provided in walls 6A, are provided opposite the walls 6C such that fluid can flow into and out of the cavities 4 of the attenuator bodies 6 through the open apertures 3 without obstruction from the other attenuator bodies 6 of the pair.

The open apertures 3 of the attenuator bodies 6 of the second pair 32 face open apertures of attenuator bodies 6 of the first and third pairs 30, 34 respectively. The cavities 4 and open apertures 3 of each of the attenuator bodies 6 define resonant frequency bands which at least partially overlap (and which in fact are identical in the embodiment shown). In addition, gaps are provided between the open apertures which face each other, the gaps being sized such that fluid resonating in the cavity 4 of an attenuator body 6 of the second pair 32 stimulates fluid resonance of fluid in the cavity 4 of the attenuator body 6 of the first or third pair 30, 34 whose aperture its own aperture faces (and typically vice versa) through the facing apertures (at least when the resonance occurs at a frequency within the overlapping portion of the said resonant frequency bands of the attenuator bodies).

The attenuator bodies of the said pairs of attenuators 30, 32 and 34 define resonant frequency bands across which they attenuate acoustic waves, and can thus be used to attenuate acoustic waves emitted by an acoustic wave source which emits acoustic waves within the said resonant frequency bands. Typically the pairs of attenuators 30, 32, 34 are provided in an acoustic barrier or enclosure provided in an acoustic wave propagation path extending from the said acoustic wave source.

This arrangement helps to increase the fluid resonance coupling between attenuators per unit volume, which in turn helps to increase the attenuation provided by the attenuators, and increases the overall resonant frequency spectrum of the attenuators (thereby increasing the frequencies across which the attenuators attenuate acoustic waves).

It may be that the apertures 3 do not directly face the acoustic waves emitted by the acoustic wave source. For example, the acoustic wave source may emit acoustic waves towards the pairs of attenuator bodies 30, 32, 34 from the left or right hand side in the view of FIG. 14.

It will be understood that the pairs of attenuators 30, 32, 34 may comprise attenuator bodies of any alternative suitable shape.

As shown in FIG. 14 it may be that the attenuator bodies of each of the pairs 30, 32, 34 are identical to each other (albeit within each pair it may be that the bodies are oriented differently from each other).

Figure 15:
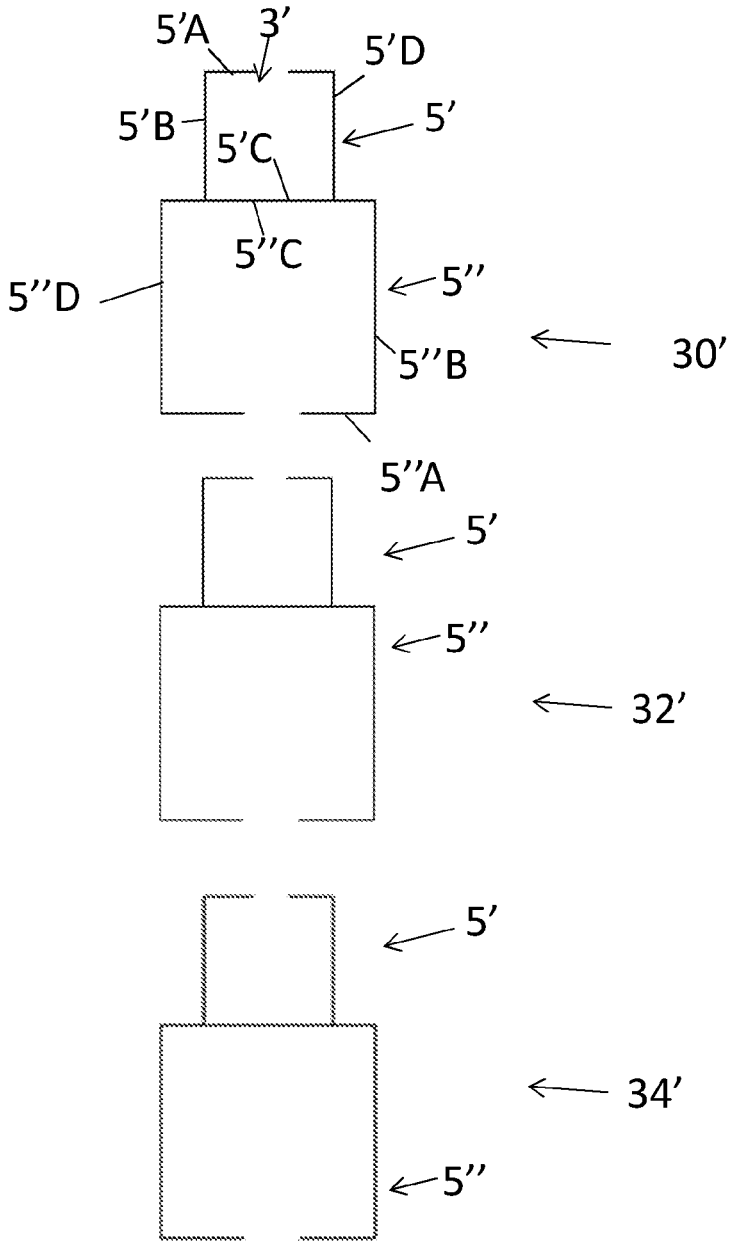
FIG. 15 is a sectional view of six alternative elongate acoustic attenuators taken perpendicular to their longitudinal axes, the acoustic attenuators being arranged in back-to-back pairs with their open apertures facing outwards, the attenuators within each pair being of different sizes.

Alternatively the attenuator bodies within each of the pairs 30, 32, 34 may be provided with different sizes and/or shapes from each other. For example, as illustrated in FIG. 15, a plurality of identical pairs of attenuator bodies 30', 32', 34' may be provided, each pair comprising first and second attenuator bodies 5', 5" of the type shown in FIG. 3 (similar features will be referred to using the same reference numerals as FIG. 3 but also including ' and " respectively therein) and described above with reference thereto which have the same shape (with a square cross section perpendicular to their longitudinal axes in the embodiment of FIG. 15) but different sizes from each other. That is, the first attenuator body 5' of each pair is of a smaller size than the second attenuator body 5" of that pair. The first and second attenuator bodies 5', 5" of each pair have adjacent and abutting faces 5'C, 5"C. The face 5"C of the second attenuator 5" completely overlaps and extends beyond the face 5'C of the first attenuator 5'. As the volumes of the cavities defined by the attenuator bodies 5', 5" are different from each other, the attenuator bodies 5', 5" have different resonant frequency bands (which may or may not overlap with each other), e.g. for attenuating acoustic waves of different frequencies.

As shown in FIG. 15, the second attenuator body 5" of the first pair 30' faces the first attenuator body 5' of the second pair 32' and the second attenuator body 5" of the second pair faces the first pair 5' of the third pair. Where there is no overlap in the resonant frequency bands of the attenuator bodies 5', 5", it may be that there is no resonant coupling between the attenuator bodies of adjacent pairs.

Figure 16:
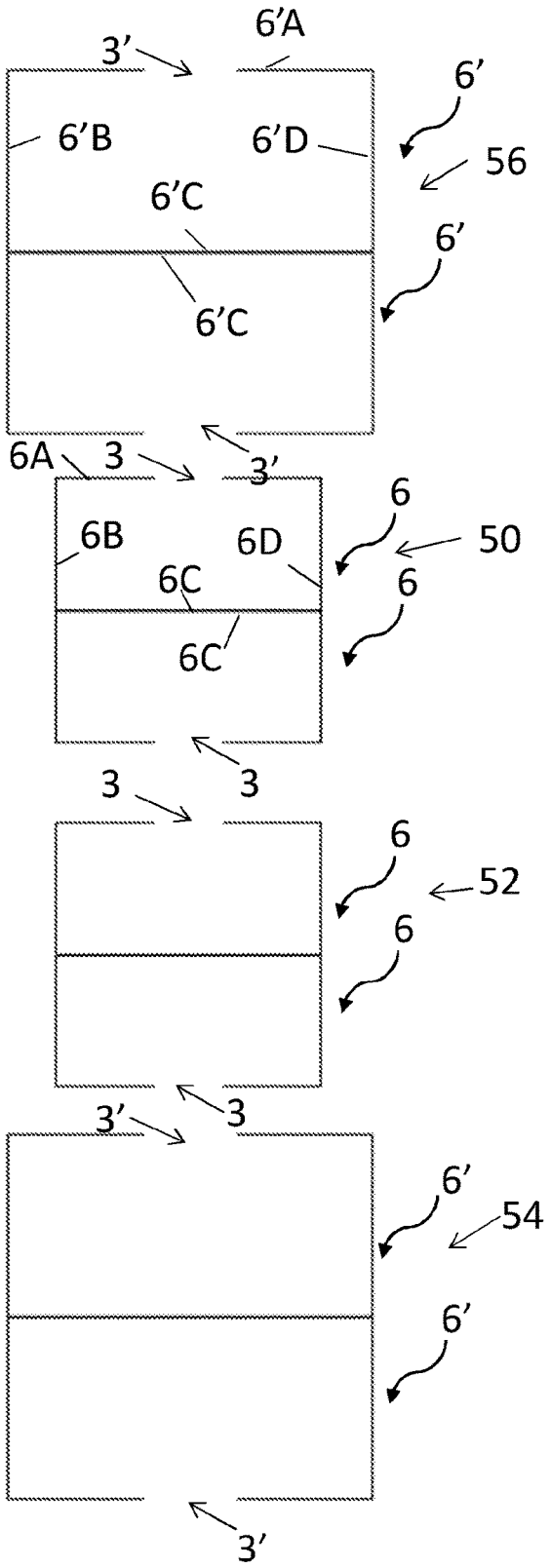
FIGS. 16 and 17 are sectional view of eight elongate acoustic attenuators taken perpendicular to their longitudinal axes, the acoustic attenuators being arranged in back-to-back pairs with their open apertures facing outwards, the attenuators of two pairs being of different sizes from attenuators of the other two pairs.

It may be that different pairs of attenuators within the row have different shapes and/or sizes and/or resonant frequency bands from other pairs of that row. For example, as shown in FIG. 16, a row may comprise two adjacent inner pairs 50, 52 of attenuator bodies 6 of the type shown in FIG. 4 and two outer pairs 54, 56 of attenuators 6' of the type shown in FIG. 4 (similar features of body 6' to body 6 will be referred to using the same reference numerals but also including ' therein) each of which is adjacent one of the inner pairs 50, 52 (the attenuator bodies within each pair being arranged as set out above with respect to FIG. 14). Within each pair 50, 52, 54, 56, the attenuator bodies have the same size, shape and resonant frequency band. However, the attenuator bodies of the inner pairs 50, 52 are of a smaller size (and have different resonant frequency bands) from the outer pairs 54, 56. The inner pairs 50, 52 are identical to each other, while the outer pairs 54, 56 are identical to each other.

As shown in FIG. 16, apertures 3 of the attenuator bodies 6 of the inner pairs 50, 52 provided opposite each other face each other. As those attenuator bodies 6 have identical resonant frequency bands, there is a strong resonance coupling between the attenuator bodies 6 of the inner pairs 50, 52. However, as the attenuator bodies 6, 6' do not have even partially overlapping frequency bands, there is little (if any) resonance coupling between the inner pair 50 and outer pair 56 and between inner pair 52 and outer pair 54 despite the fact that apertures 3 of attenuator bodies 6 of the said inner pairs 50, 52 face and are in fluid communication with apertures 3' of attenuator bodies 6' of the adjacent outer pairs 54, 56. In some embodiments, it may be that the four pairs of attenuators 50-56 are a repeating unit of attenuators which are stacked on top of each other in use. In this case, there will be adjacent pairs of attenuators 6' between which there is resonance coupling (between adjacent repeating units).

Figure 17:
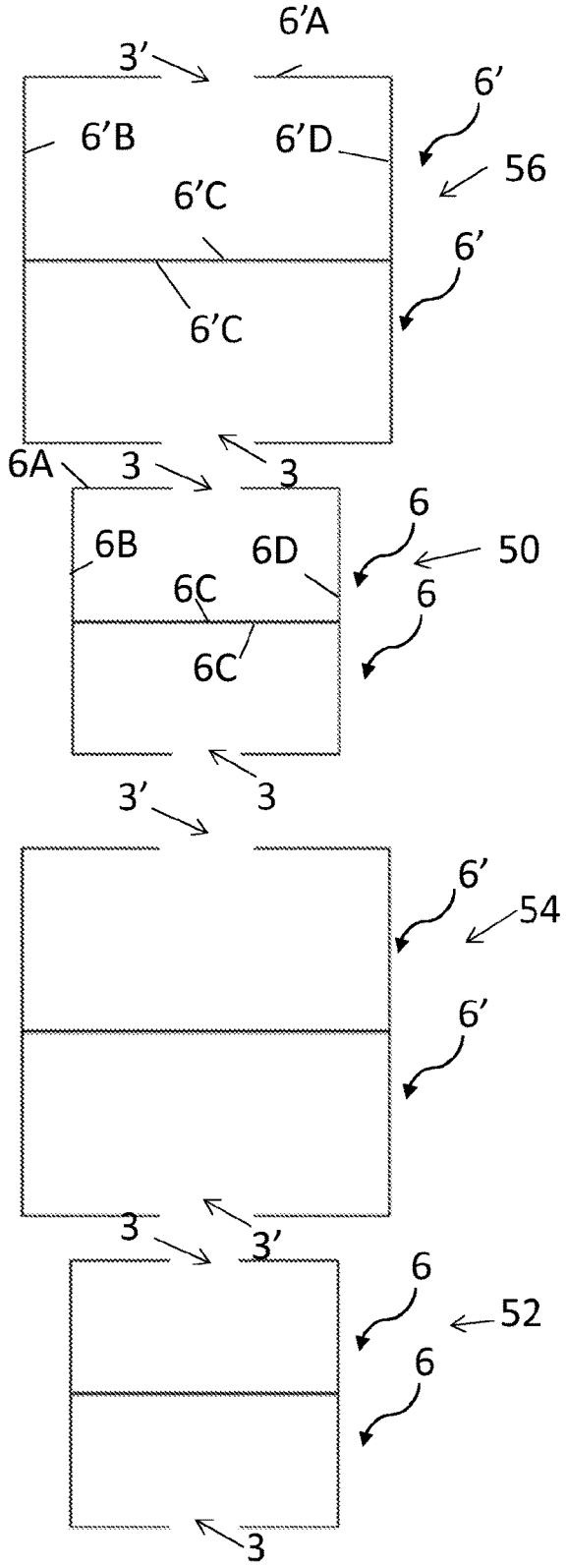

As shown in FIG. 17, the pairs 50-56 may be re-arranged such that pairs 50, 54 are the inner pairs and pairs 56 and 52 are the outer pairs. In this case, there will be no resonance coupling between any of the pairs 50-56 within the row of four pairs 50-56. However, it may be that the four pairs of attenuators 50-56 are a repeating unit of attenuators which are stacked on top of each other in use. In this case, there may be adjacent pairs of attenuators 6' between a first pair of repeating units and/or adjacent pairs of attenuators 6 between a second pair of repeating unit which provide resonance coupling.

Figure 18:
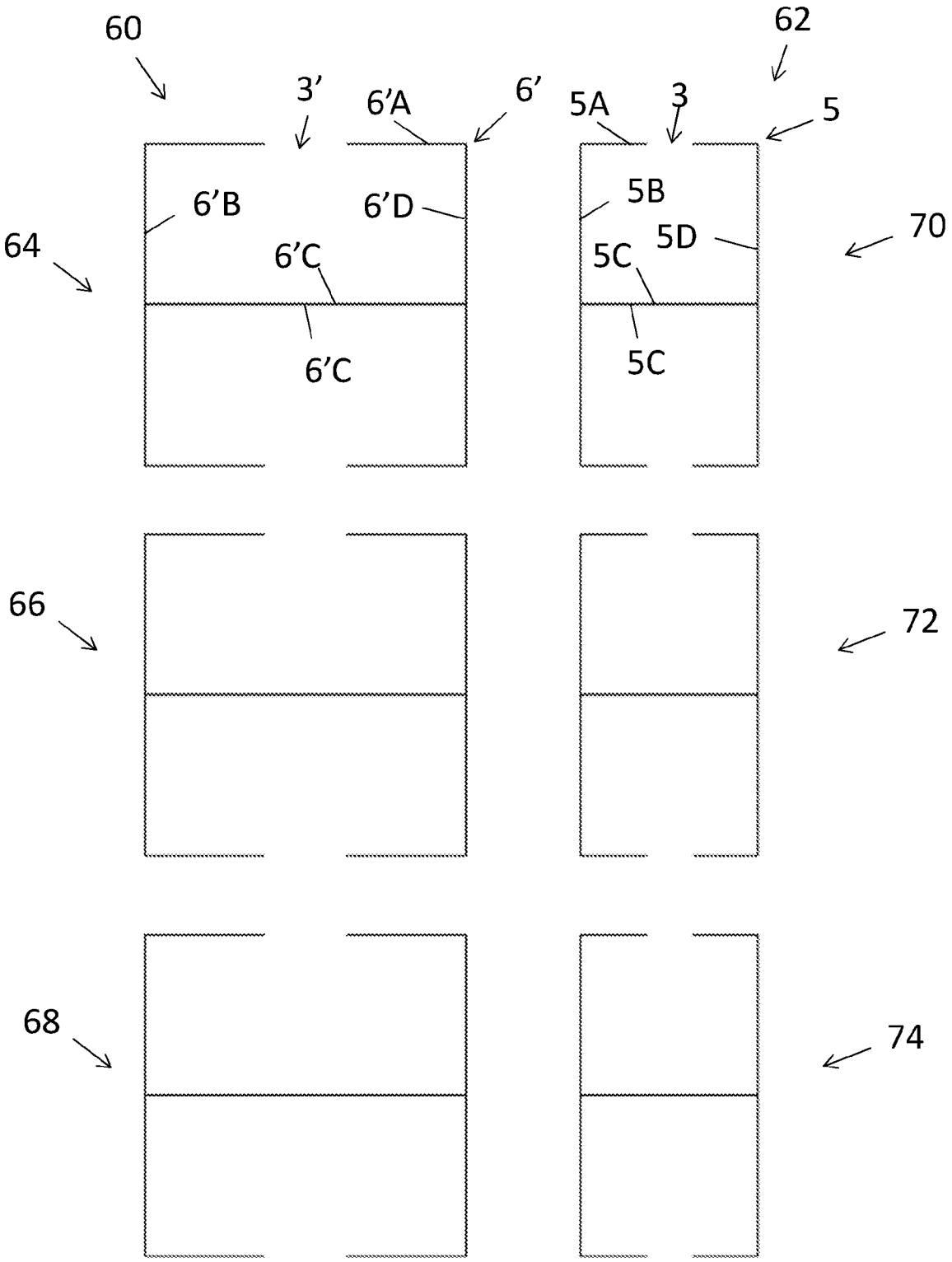
FIG. 18 shows two opposing rows of pairs of attenuators, the said rows being spaced apart from each other.

As shown in FIG. 18, first and second rows 60, 62 may be provided, the first row 60 comprising three adjacent pairs 64, 66, 68 of attenuator bodies 6' (of the type shown in FIG. 4 and described above with reference thereto) and the second row 62 comprising three adjacent pairs 70, 72, 74 of attenuator bodies 5 (of the type shown in FIG. 3 and described with reference thereto above). The attenuator bodies within each pair are identical to each other and are arranged as described above with reference to FIG. 14. The pairs within each row 60, 62 are identical to each other and are arranged as described above with reference to FIG. 14, and therefore resonance coupling occurs between attenuator bodies 6' of the pair 66 of the first row and a respective attenuator body 6' of adjacent pairs 64, 68. Similarly, resonance coupling occurs between attenuator bodies 5 of the pair 72 of the second row 62 and a respective attenuator body of the adjacent pairs 70, 74. The cavities and apertures of the attenuator bodies of the first row 60 at least partly define first resonant frequency bands across which they attenuate incident acoustic waves (by stimulation of resonance of fluid within the cavities by incident acoustic waves) and apertures and cavities of the attenuator bodies of the second row define second resonant frequency bands across which they attenuate incident acoustic waves (by stimulation of resonance of fluid within the cavities by incident acoustic waves) different from the first resonant frequency bands. The attenuator bodies 6' of each pair 64, 66, 68 of the first row 60 are provided opposite respective attenuator bodies 5 of each pair 70, 72, 74 of the second row 62. The first and second rows 60, 62 are spaced from each other by a gap. The distances between the opposing walls 6'B, 6'D of the attenuator bodies 6' of the first row 60 are different from the distances between the opposing walls 5B, 5D of the attenuator bodies 5 of the second row 62, so that they define different frequencies (or frequency bands) across which the opposing walls of those attenuator bodies scatter incident acoustic waves such that the said scattered acoustic waves interfere with each other and are thereby attenuated. The distance between the opposing walls 6'D, 5B of opposing attenuators between the first and second rows 60, 62 may be the same as the distances between opposing walls 6'B, 6'D of the attenuator bodies 6' of the first row 60 or as the distances between the opposing walls 5B, 5D of the attenuator bodies 5 of the second row 62 (so as to improve the attenuation effect provided thereby) or the distance between the opposing walls 6'D, 5B of opposing attenuators between the first and second rows 60, 62 may be different from the distances between opposing walls 6'B, 6'D of the attenuator bodies 6' of the first row 60 and the distances between the opposing walls 5B, 5D of the attenuator bodies 5 of the second row 62 so as to define a further frequency across which incident acoustic waves are scattered such that they interfere with each other and are thereby attenuated. Typically the said distances are selected to attenuate frequencies of acoustic wave emitted by the or an acoustic wave source which emits acoustic waves along an acoustic wave propagation path including the said row.

The first and second rows 60, 62 are typically spaced from each other to thereby define a further resonant frequency band across which incident acoustic waves are attenuated. The first and second rows 60, 62 may be first and second rows of a plurality of rows which are spaced (e.g. periodically) from each other to thereby define a further resonant frequency band across which incident acoustic waves are attenuated. Typically the said spacing is selected to attenuate frequencies of acoustic wave emitted by the or an acoustic wave source which emits acoustic waves along an acoustic wave propagation path including the said row.

Figure 19:
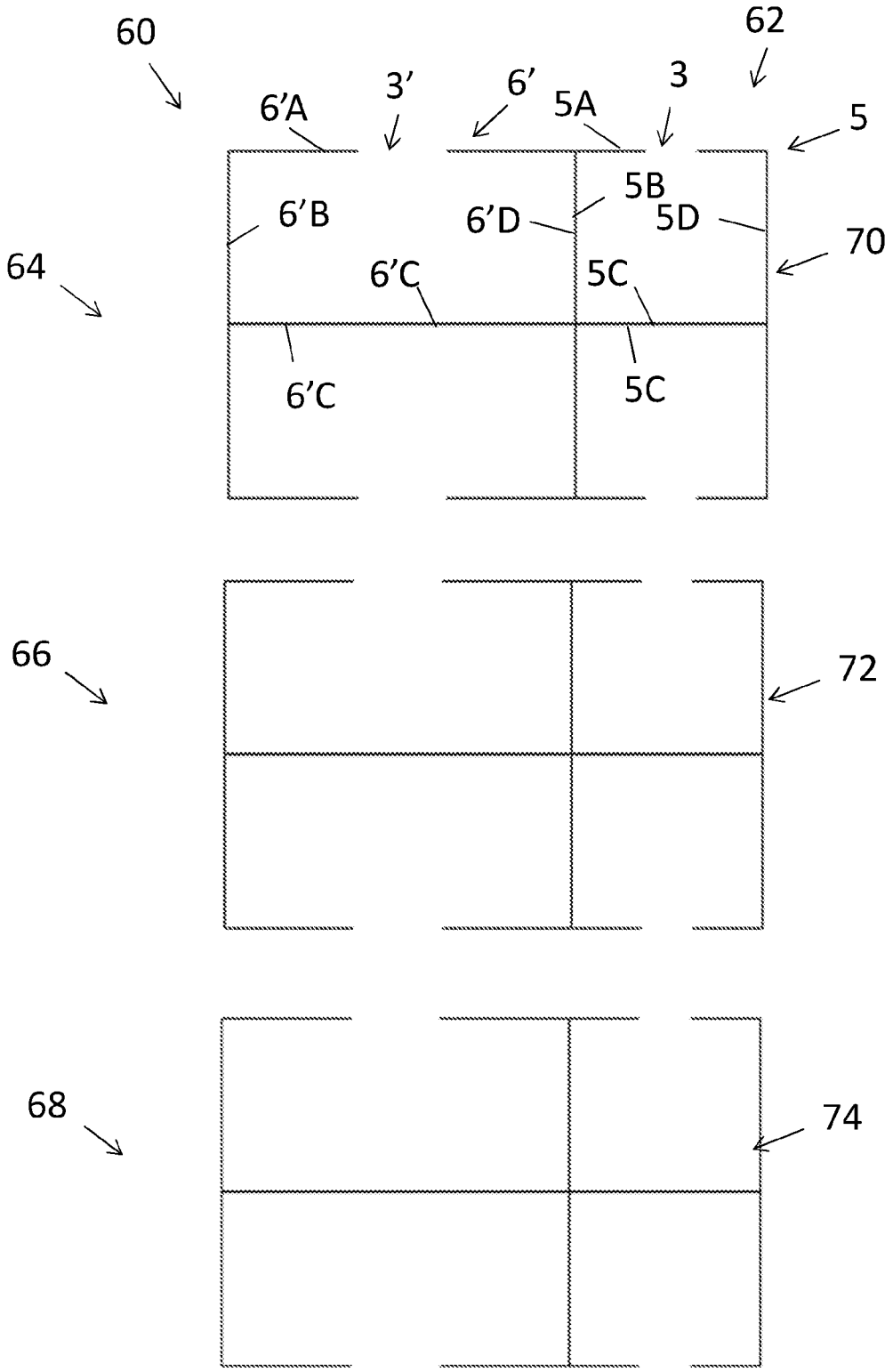
FIG. 19 shows a similar arrangement to FIG. 18, but with the attenuators of the opposing rows abutting each other and being mechanically coupled to each other.
Figure 20:
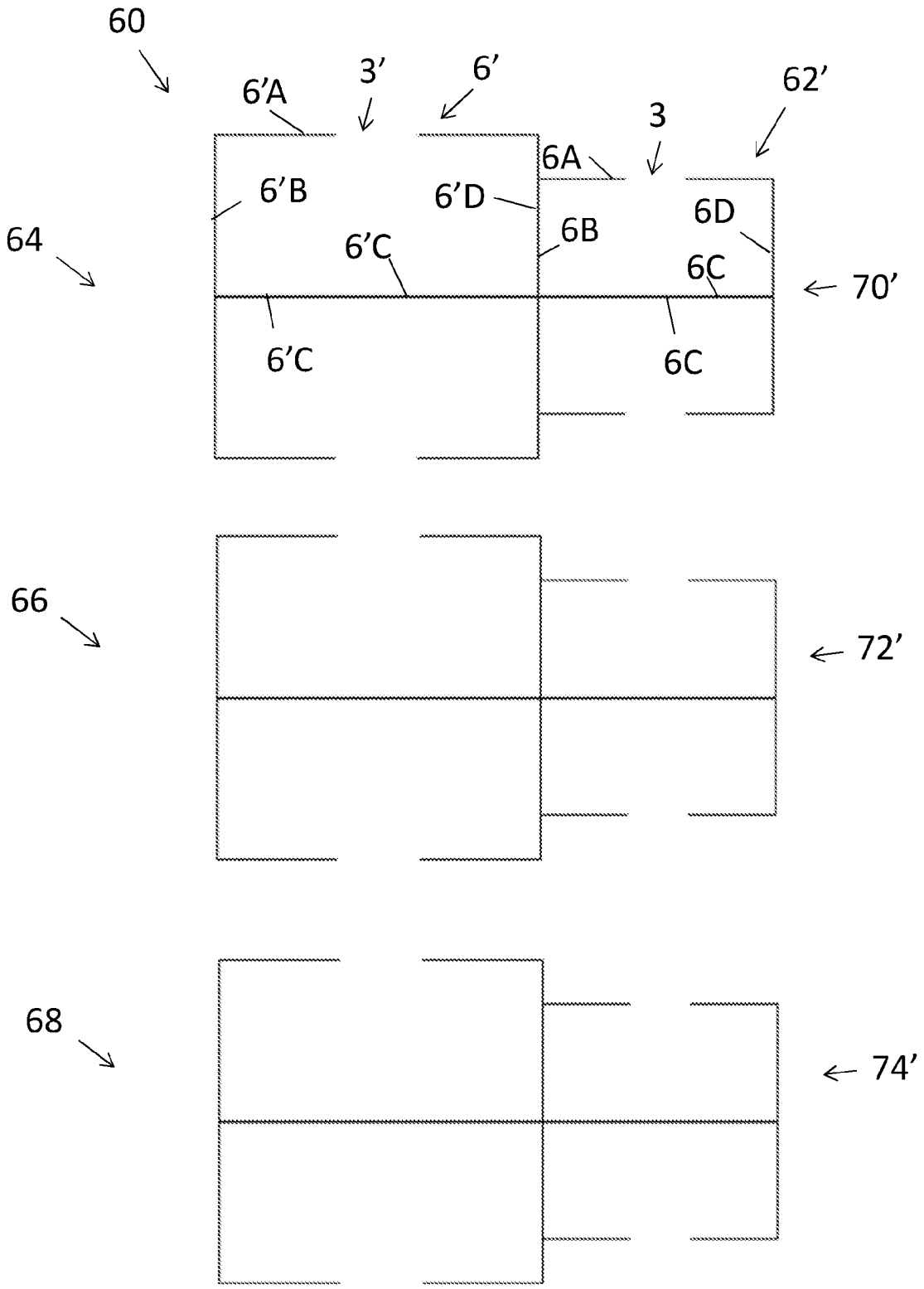
FIG. 20 shows a similar arrangement to FIG. 19, but with the first faces of the attenuators of the second row being set back from the first faces of the attenuators of the first row.

As shown in FIG. 19, it may be that instead of a gap being provided between the first and second rows, opposing attenuator bodies of the first and second rows may abut each other. As also shown in FIG. 19, it may be that the first faces 5A, 6'A of the opposing attenuator bodies between rows are flush with each other. Alternatively, as shown in FIG. 20 (in which an alternative second row 62' comprising pairs of attenuators 6 of the type shown in FIG. 4 are provided instead of the attenuators 5 of the type shown in FIG. 3), it may be that first faces 6A, 6'A of the opposing attenuator bodies are not flush with each other. In the embodiment shown in FIG. 20, the first faces 6A of the attenuators 6 of the second row 62' are set back from the from the first faces 6A' of the attenuators 6' of the first row 60.

It is typically preferable for the first faces of the opposing attenuators of the first and second rows to be flush with each other so as to provide a more practical arrangement for use in an acoustic barrier, and to enhance the fluid coupling effect which can be achieved with attenuator bodies of adjacent pairs of attenuator bodies within each row (as the distance between opposing apertures within the row will be decreased), where possible.

Figure 3:
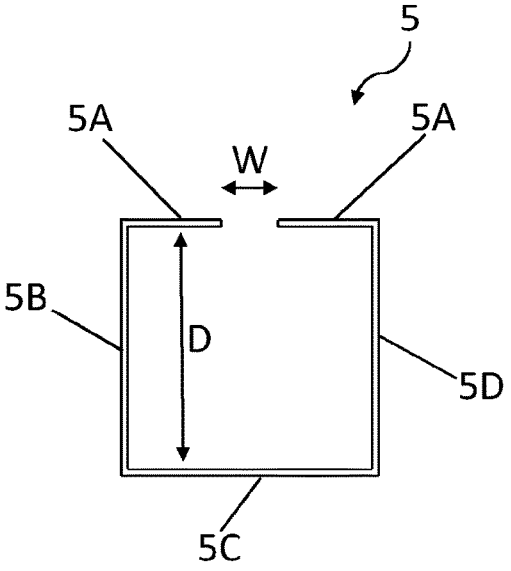
FIG. 3 is a cross section through an alternative acoustic attenuator.
Figure 21:
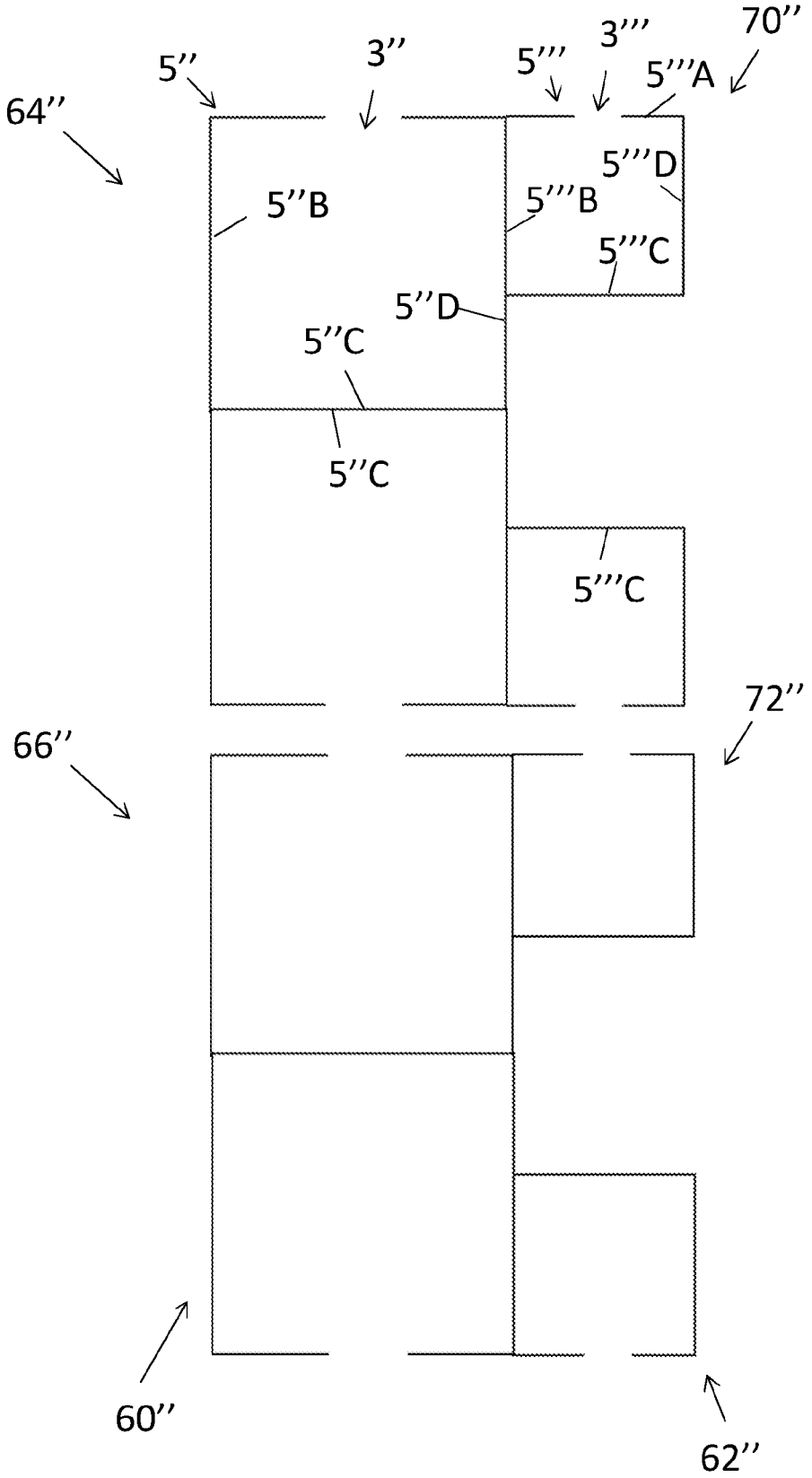
FIG. 21 shows a similar arrangement to FIG. 19, but with gaps being provided between the second faces of the attenuators of each pair of the second row such that the first faces of the attenuators of each pair of the second row are flush with the first faces of the attenuators of each pair of the first row.

FIG. 21 shows adjacent first and second rows 60", 62", the first row comprising adjacent pairs 64", 66" of attenuator bodies 5" of the type shown in FIG. 3 and described above with reference thereto arranged as described above with reference to FIG. 14, the second row also comprising pairs 70", 72" of attenuator bodies 5'" of the type shown in FIG. 3 and described above with reference thereto (similar features will be referred to using the same reference numerals as FIG. 3 but also including " and '" respectively therein), but where the adjacent faces 5'"C of adjacent attenuator bodies 5'" are spaced apart from each other within the second row 62" such that the first faces 5'"A of the attenuator bodies of the second row are flush with the first faces 5"A of the attenuator bodies of the first row 60" which they oppose. As above, this provides a practical arrangement for using the first and second rows 60", 62" in an acoustic barrier, and to enhance the fluid resonance coupling effect which can be achieved between adjacent attenuator bodies 5'" of adjacent pairs within the second row 62" (as the distance between opposing apertures within the row will be decreased).

Figure 22:
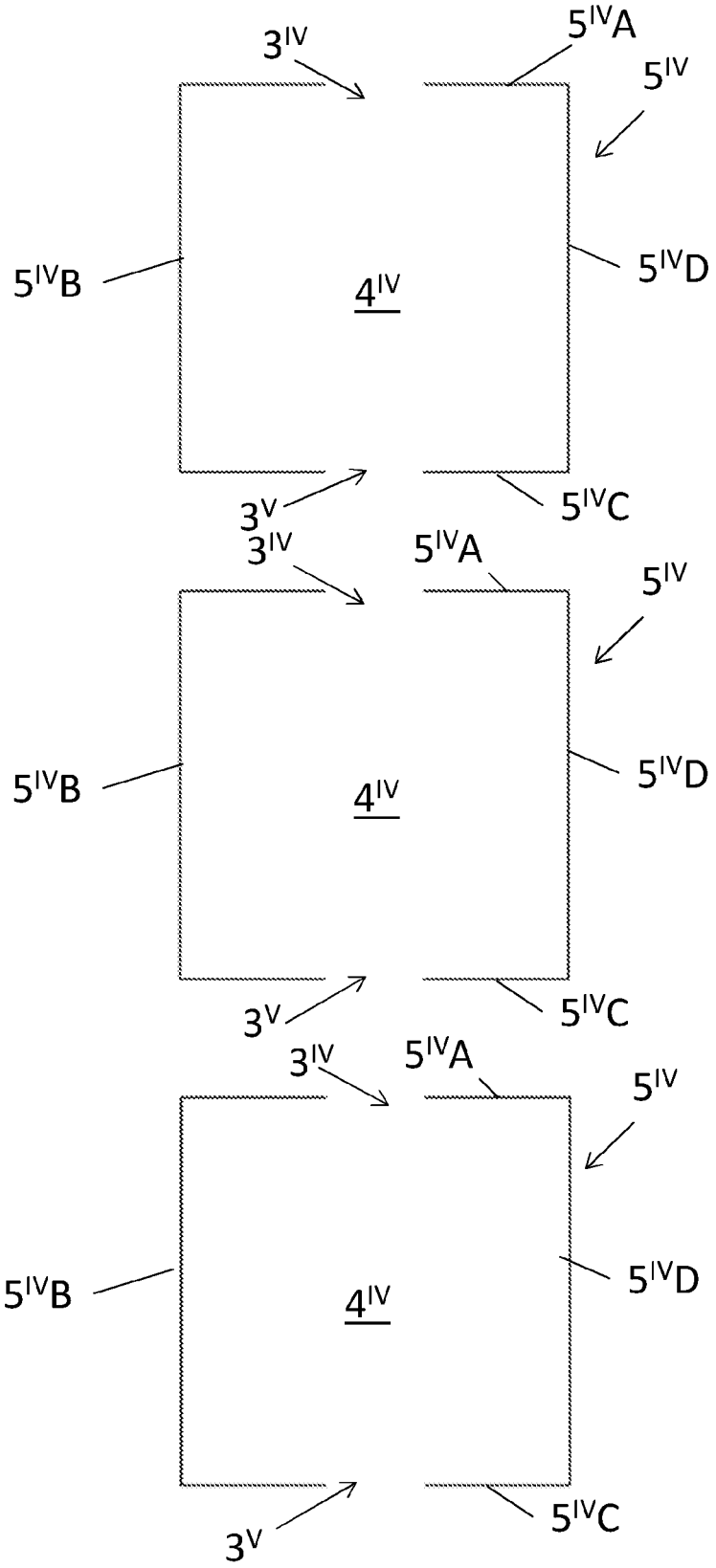
FIG. 22 is a sectional view of three elongate acoustic attenuators, each of which comprises opposing pairs of elongate open apertures.

FIG. 22 shows first (top), second (middle) and third (bottom) attenuator bodies $\mathbf{5}^{IV}$ which are similar to the attenuator bodies 5 shown in FIG. 3, but wherein in each case a second elongate open aperture $\mathbf{3}^{V}$ is provided in the wall $\mathbf{5}^{IV}$C, the said second open aperture $\mathbf{3}^{V}$ being in fluid communication with the cavity $\mathbf{4}^{IV}$ of the attenuator body. Similar features will be referred to using the same reference numerals as FIG. 3 but also including $^{IV}$ therein. The two open apertures $\mathbf{3}^{IV}$, $\mathbf{3}^{V}$ of each attenuator body $\mathbf{5}^{IV}$ are offset from each other around the longitudinal axis of the attenuator body $\mathbf{5}^{IV}$ and are provided directly opposite each other. By providing the open apertures $\mathbf{3}^{IV}$, $\mathbf{3}^{V}$, two masses of fluid will resonate within the cavity (as a result of fluid being able to flow into and out of the cavity through the two apertures $\mathbf{3}^{IV}$, $\mathbf{3}^{V}$) when acoustic waves having a frequency within the resonant frequency band of the attenuator body $\mathbf{5}^{IV}$ are incident on the apertures $\mathbf{3}^{IV}$, $\mathbf{3}^{V}$ thereby significantly increasing the acoustic attenuation provided by the attenuator body $\mathbf{5}^{IV}$. The symmetry provided by having the open apertures $\mathbf{3}^{IV}$, $\mathbf{3}^{V}$ directly opposite each other helps to optimise the resonance (and thus acoustic attenuation) performance of the attenuator body $\mathbf{5}^{IV}$. In addition, each of the open apertures $\mathbf{3}^{IV}$, $\mathbf{3}^{V}$ can resonantly couple the cavity $\mathbf{4}^{IV}$ defined by each said attenuator body $\mathbf{5}^{IV}$ to the cavities of first and second adjacent ("nearest neighbour") attenuator bodies. This helps to improve the resonance coupling effect between attenuator bodies per unit volume (the said cavity of the said body being resonantly coupled to the cavities of two adjacent attenuator bodies), which increases the level of attenuation provided. This also helps to broaden the frequency range of attenuation provided.

In the illustrated embodiment, the first, second and third attenuator bodies $\mathbf{5}^{IV}$ are identical to each other and are therefore provided with identical resonant frequency bands.

The open apertures $\mathbf{3}^{IV}$, $\mathbf{3}^{V}$ of the second attenuator body $\mathbf{5}^{IV}$ face open apertures of the first and third attenuator bodies $\mathbf{5}^{IV}$ respectively. Gaps are provided between the open apertures which face each other, the gaps being sized such that fluid resonating within the cavity $\mathbf{4}^{IV}$ of the second attenuator body $\mathbf{5}^{IV}$ stimulates resonance of fluid within the first and third attenuator bodies $\mathbf{5}^{IV}$ (and typically vice versa) through the facing apertures (at least when the resonance occurs at a frequency within the said resonant frequency bands of the attenuator bodies).

The attenuator bodies $\mathbf{5}^{IV}$ define resonant frequency bands across which they attenuate acoustic waves, and can thus be used to attenuate acoustic waves emitted by an acoustic wave source which emits acoustic waves within the said resonant frequency bands. Typically the attenuator bodies $\mathbf{5}^{IV}$ are provided in an acoustic barrier or enclosure provided in an acoustic wave propagation path extending from the said acoustic wave source.

By providing the attenuator bodies $\mathbf{5}^{IV}$ with first and second apertures which each permit fluid resonance coupling with neighbouring attenuators, the fluid resonance coupling between attenuators per unit volume can be increased, which in turn helps to increase the attenuation provided by the attenuator arrangement, and increases the overall resonant frequency spectrum of the attenuator arrangement (thereby increasing the frequencies across which the attenuator arrangement attenuates acoustic waves).

It may be that the apertures $\mathbf{3}^{IV}$, $\mathbf{3}^{V}$ do not directly face the acoustic wave source.

Figure 23:
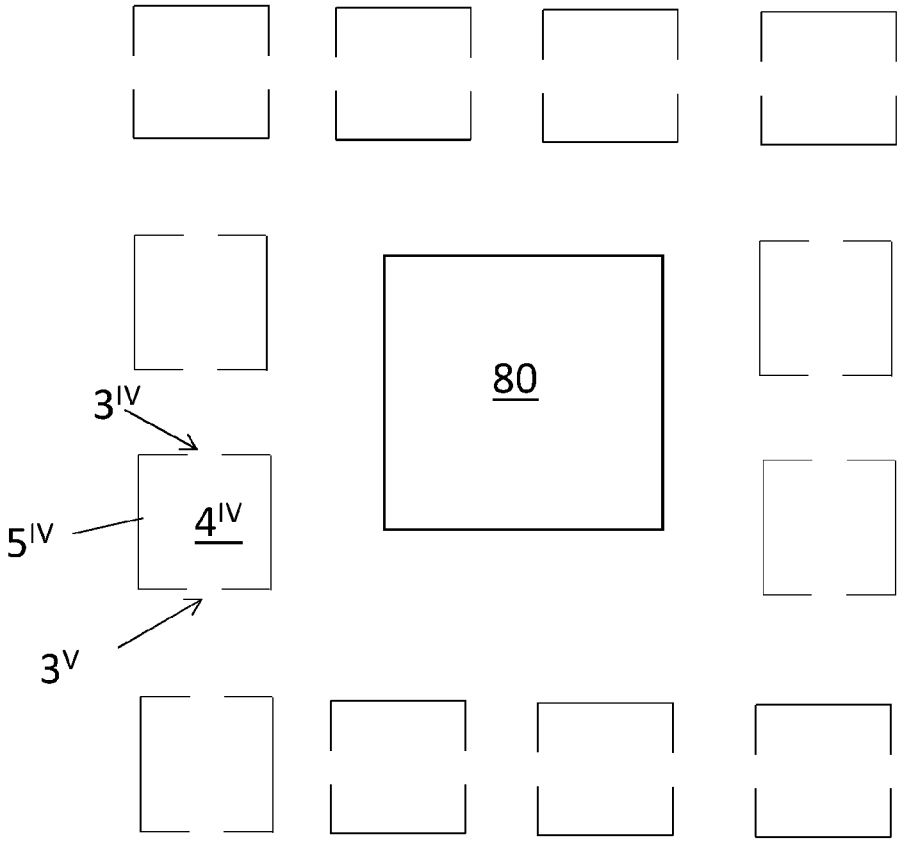
FIG. 23 shows an acoustic noise source within an acoustic enclosure comprising a plurality of the acoustic attenuators shown in FIG. 15.

FIG. 23 shows an acoustic wave source 80 provided within an acoustic enclosure formed from twelve of the acoustic attenuator bodies $\mathbf{5}^{IV}$ shown in FIG. 22 and described above with reference thereto. The acoustic wave source 80 emits acoustic waves along a plurality of acoustic wave propagation paths such that acoustic waves emitted from the acoustic wave source are incident on each of the attenuator bodies $\mathbf{5}^{IV}$. The attenuator bodies $\mathbf{5}^{IV}$ (and typically opposing first and second walls thereof) define (e.g. resonant) frequency bands comprising frequencies of acoustic waves emitted by the acoustic wave source 80 such that incident acoustic waves stimulate resonance of fluid (typically air) within the cavities defined by the bodies $\mathbf{5}^{IV}$ (typically having passed through one of the open apertures $\mathbf{3}^{IV}$, $\mathbf{3}^{V}$ of that body), and typically incident acoustic waves emitted by the acoustic wave source are scattered by the opposing first and second walls $\mathbf{5}^{IV}$B, $\mathbf{5}^{IV}$D of the said attenuator bodies, the scattered waves (typically destructively) interfering with each other to thereby attenuate the said incident acoustic waves. Resonant coupling occurs between adjacent ones of the attenuator bodies $\mathbf{5}^{IV}$ having open apertures $\mathbf{3}^{IV}$, $\mathbf{3}^{V}$ which face each other. Typically said adjacent attenuator bodies $\mathbf{5}^{IV}$ are provided with resonant frequency bands which at least partially overlap. Thus, the attenuator bodies $\mathbf{5}^{IV}$ attenuate acoustic waves emitted by the acoustic wave source 80. It will be understood that the bodies $\mathbf{5}^{IV}$ could be replaced with the pairs of bodies shown in any of FIGS. 14-21.

Further modifications and variations may be made within the scope of the invention herein disclosed.

For example, although the acoustic attenuators forming each of the acoustic barriers in FIGS. 10-13 are illustrated as being identical to each other, it may be that some of the acoustic attenuators of the plurality of acoustic attenuators forming the barrier are different from each other. In this case, it may be that each of the acoustic attenuators is of the same type (e.g. of the type shown in FIGS. 1, 2, or of the type shown in any other Figure), but having different resonant frequency bands or Bragg conditions. Alternatively, it may be that the plurality of acoustic attenuators forming the acoustic barrier comprise different types of acoustic attenuator (e.g. a first one or group of the acoustic attenuators may be of a type shown in one of the FIGS. 1-9, and a second one or group of the acoustic attenuators may be of a type shown in one of FIGS. 1-9 different from the first one or group of acoustic attenuators). It will be understood that any relevant selection may be made, dependent on the frequencies of acoustic waves emitted by the source 20 which need to be attenuated, and how much attenuation is required/desired.

It will also be understood that there do not need to be gaps provided between adjacent acoustic attenuators in the enclosures of FIGS. 10-13. Gaps can be advantageous where for example the acoustic wave source also generates heat because heated air can disperse through the gaps, and cool air can enter the enclosure through the gaps. However, in some cases, it may be that there are no gaps between adjacent attenuators. For example, adjacent attenuators may abut each other to form unitary panels.

It will also be understood that, although it can be beneficial for the open apertures of the acoustic attenuators to have a direct line of sight to the acoustic wave source (as shown in FIGS. 10-13), it may be in other embodiments that there is no direct line of sight between the open apertures and the acoustic wave source. However there should at least be fluid communication between the acoustic wave source and the open apertures.

It will also be understood that, although the walls providing the sonic crystal effect described above are said to be parallel in the exemplary embodiments, it may be that the walls providing the sonic crystal effect are not exactly parallel and the one dimensional sonic crystal effect is still observed. For example, it may be that a transversal line extending between the said walls intersects the walls with corresponding angles between the said transversal and the respective walls which differ from each other by 20° or less. Preferably, the corresponding angles differ from each other by 10° or less, more preferably by 5° or less, more preferably 2.5° or less, more preferably 1° or less, even more preferably the corresponding angles are the same.

It will also be understood that, although the acoustic attenuators are illustrated as being oriented vertically in the appended figures, the acoustic attenuators may alternatively be oriented horizontally (or indeed in any suitable orientation).

It will also be understood that each of the pairs of attenuators within each row of the embodiments of FIGS. 16-20 could be replaced with (single) attenuators of the type shown in FIG. 22.

The invention claimed is:

1. An acoustic attenuator comprising:

a first body defining a cavity therein and having at least one open aperture in fluid communication with the cavity; and opposing first and second walls, the second wall being substantially parallel to the first wall, the first body comprising the first and second walls, wherein the aperture and the cavity at least partly define a resonant frequency band across which the first body attenuates incident acoustic waves, the first and second walls are separated by a gap, and the gap between the first and second walls is substantially equal to an integer or half-integer number of wavelengths of the incident acoustic waves to be attenuated such that the incident acoustic waves to be attenuated are scattered by the first and second walls, and the scattered waves interfere with each other to attenuate the incident acoustic waves.

2. The acoustic attenuator according to claim 1 wherein the first wall comprises the open aperture.

3. The acoustic attenuator according to claim 1 wherein the first body has a cross section perpendicular to its longitudinal axis which is trapezoidal.

4. The acoustic attenuator according to claim 1 comprising a plurality of bodies, each of the plurality of bodies defining a cavity therein and having: at least one open aperture in fluid communication with the cavity; opposing first and second walls, the second wall being substantially parallel to the first wall, wherein the aperture and the cavity at least partly define a resonant frequency band across which it attenuates incident acoustic waves, and wherein the first and second walls are separated by a gap.

5. The acoustic attenuator according to claim 4 wherein a plurality of the plurality of bodies are arranged together in a row.

6. The acoustic attenuator according to claim 4 wherein a plurality of the plurality of bodies are fixedly attached to a frame extending between them.

7. The acoustic attenuator according to claim 4 wherein a plurality of the plurality of bodies are fixedly coupled to each other to form a panel.

8. The acoustic attenuator according to claim 4 wherein a plurality of the plurality of bodies are arranged to form an enclosure.

9. The acoustic attenuator according to claim 1 further comprising a second body wherein the second body is provided next to the first body.

10. The acoustic attenuator according to claim 8 wherein the second body is provided next to the first body.

11. The acoustic attenuator according to claim 1 wherein a transversal line extending between the first and second walls intersects the first and second walls with corresponding angles between the transversal and the respective first and second walls differing from each other by 20° or less.

12. An acoustic attenuator system comprising: a first acoustic attenuator according to claim 1; and a second acoustic attenuator, wherein one or more open apertures of the first acoustic attenuator face(s) one or more open apertures of the second acoustic attenuator and a gap is provided between the open apertures.

13. The acoustic attenuator system according to claim 12 wherein the bodies of the first and second attenuators are provided with at least partially overlapping resonant frequency bands.

14. The acoustic attenuator system according to claim 12 wherein one of the first and second walls of the first acoustic attenuator is parallel to one of the first and second walls of the second acoustic attenuator, wherein the one of the first and second walls of the first acoustic attenuator is spaced from said one of the first and second walls of the second attenuator such that incident acoustic waves scattered by the walls and having a frequency and angle of incidence on the walls satisfying the Bragg condition defined by the spacing between them interfere with each other such that said incident acoustic waves are thereby attenuated.

15. The acoustic attenuator system according to claim 14 wherein the gap between the first and second walls of the first acoustic attenuator, the gap between the first and second walls of the second acoustic attenuator and a gap between the first and second acoustic attenuators are equal.

16. The acoustic attenuator system according to claim 12, further comprising a third attenuator wherein the body of each of the first and third acoustic attenuators comprises a first face and a second face, the first face comprising the open aperture of that body, and wherein the bodies of the first and third attenuators are arranged such that their second faces are adjacent to each other and that fluid can flow into or out of the cavities of the first and third attenuators of the pair through their respective open apertures.

17. The acoustic attenuator system according to claim 16 further comprising a fourth acoustic attenuator having an open aperture in fluid communication with, and facing, the open aperture of the third acoustic attenuator, the bodies of the third and fourth acoustic attenuators at least partly defining at least partially overlapping resonant frequency bands and a gap being provided between the open apertures of the third and fourth acoustic attenuators, the gap being sized such that resonance of fluid within the cavity of the third acoustic attenuator can stimulate resonance of fluid within the cavity of the fourth acoustic attenuator.

18. The acoustic attenuator system according to claim 12 wherein the open aperture of the body of the first acoustic attenuator is a first of first and second open apertures in fluid communication with the cavity defined by the body of the first acoustic attenuator, the first and second open apertures being offset from each other around the longitudinal axis of the body of the first acoustic attenuator.

19. The acoustic attenuator system according to claim 17 wherein the first and second open apertures are provided directly opposite each other.

20. The acoustic attenuator system according to claim 18 wherein the first said open aperture is in fluid communication with, and faces, an open aperture of a third acoustic attenuator, and the second said open aperture is in fluid communication with, and faces, an open aperture of a fourth acoustic attenuator, wherein the body of the first attenuator defines a resonant frequency band which at least partially overlaps with resonant frequency bands defined by the bodies of the third and fourth attenuators, and gaps are provided between the first and second said open apertures and the open apertures of the third and fourth attenuators, the gaps being sized such that resonance of fluid in the cavity defined by the body of the first attenuator can stimulate resonance of fluid within the cavities of the third and fourth attenuators.

21. An acoustic attenuator system comprising: a first acoustic attenuator according to the first aspect of the invention; and a second acoustic attenuator according to claim 1, wherein the body of each of the first and second acoustic attenuators comprises a first face and a second face, the first face comprising the open aperture of that body, and wherein the bodies of the first and second attenuators are arranged such that their second faces are adjacent to each other and that fluid can flow into or out of the cavities of the first and second attenuators of the pair through their respective open apertures.

22. The acoustic attenuator system according to claim 21 further comprising first and second rows, each of the first and second rows comprising one or more said pairs, each said pair comprising first and second acoustic attenuators, wherein the body of each of the first and second acoustic attenuators of each said pair comprises a first face and a second face, the first face comprising the open aperture of that body, and wherein the bodies of the first and second attenuators of that pair are arranged such that their second faces are adjacent to each other and that fluid can flow into or out of the cavities of the first and second attenuators of the pair through their respective open apertures.

23. The apparatus according to claim 22 wherein the attenuators within one or more or each of the pairs of the first row are provided opposite respective attenuators of respective pairs of the second row, and wherein the first faces of the attenuators of the first and second row which face each other are flush with each other.

24. The apparatus according to claim 23 wherein the second faces of the bodies of the attenuators of one or more or each said pair of bodies of one of the first and second rows abut each other, and the second faces of the attenuators of one or more or each said pair of bodies of the attenuators of the other of the first and second rows are separated by a gap.

25. Apparatus comprising: an acoustic wave source which emits acoustic waves; and an acoustic attenuator according to claim 1 provided in an acoustic wave propagation path of acoustic waves emitted by the acoustic wave source, wherein the acoustic wave source emits acoustic waves having a frequency within the resonant frequency band, and acoustic waves which are scattered by the first and second walls, the scattered waves interfering with each other such that the incident acoustic waves are thereby attenuated.

26. The apparatus according to claim 25 wherein the shortest distance between the first and second walls is equal to a wavelength of acoustic waves emitted by the acoustic wave source.

27. The apparatus according to claim 26 wherein the shortest distance between the first and second walls is substantially equal to an integer or a half-integer number of wavelengths of acoustic waves emitted by the acoustic wave source.

28. Apparatus comprising: an acoustic wave source which emits acoustic waves; and an acoustic attenuator system according to claim 12 provided in an acoustic wave propagation path of acoustic waves emitted by the acoustic wave source, wherein the acoustic wave source emits acoustic waves having a frequency within the resonant frequency bands of the bodies of the first and second acoustic attenuators, and acoustic waves which are scattered by the first and second walls of the first acoustic attenuator, the scattered waves interfering with each other such that the incident acoustic waves are thereby attenuated.

29. A method of attenuating acoustic waves emitted by an acoustic wave source, the method comprising:

acoustic waves emitted by the acoustic wave source stimulating resonance of a fluid provided within a cavity defined by a first body comprising an open aperture in fluid communication with the cavity, the first body comprising first and second walls; and the first and second walls scattering acoustic waves emitted by the acoustic wave source, wherein the first and second walls are separated by a gap that is sized such that the scattered acoustic waves interfere with each other destructively and the incident acoustic waves are thereby attenuated.

* * * * *